US011643993B2

(12) United States Patent
Carlsen

(10) Patent No.: US 11,643,993 B2
(45) Date of Patent: May 9, 2023

(54) HEAT ENGINE WITH MAGNETICALLY LINKED PISTONS

(71) Applicant: Erik K. Carlsen, Oxford, PA (US)

(72) Inventor: Erik K. Carlsen, Oxford, PA (US)

( * ) Notice: Subject to any disclaimer, the term of this patent is extended or adjusted under 35 U.S.C. 154(b) by 0 days.

(21) Appl. No.: 17/697,983

(22) Filed: Mar. 18, 2022

(65) Prior Publication Data

US 2022/0316423 A1 Oct. 6, 2022

Related U.S. Application Data

(60) Provisional application No. 63/168,563, filed on Mar. 31, 2021.

(51) Int. Cl.
*F02G 1/043* (2006.01)
*F02G 1/053* (2006.01)
*F02G 1/044* (2006.01)

(52) U.S. Cl.
CPC ..... *F02G 1/0435* (2013.01); *F02G 1/044* (2013.01); *F02G 1/0535* (2013.01); *F02G 2244/02* (2013.01)

(58) Field of Classification Search
CPC ..... F02G 2243/54; F02G 1/0435
See application file for complete search history.

(56) References Cited

U.S. PATENT DOCUMENTS 4,117,696 A * 10/1978 Fawcett ..... F01C 1/063 418/33
4,385,498 A * 5/1983 Fawcett ..... H02K 7/1869 60/649
5,923,104 A 7/1999 Haaland et al.
10,227,950 B1 * 3/2019 Dyson, Jr. ..... F02G 1/055
10,358,945 B2 7/2019 Kare et al.
2005/0091974 A1 * 5/2005 Carnahan ..... F02G 1/0435 60/517
2008/0284263 A1 11/2008 Dessirier
2013/0008163 A1 1/2013 Godot
2019/0376468 A1 12/2019 Kamen et al.

FOREIGN PATENT DOCUMENTS

CN 201954998 8/2011
CN 102692148 A 9/2012

* cited by examiner

*Primary Examiner* — Laert Dounis
(74) *Attorney, Agent, or Firm* — McCarter & English, LLP

(57) ABSTRACT

Exemplary embodiments are directed to a heat engine. The heat engine includes a pipe that defines a continuous internal path. The pipe includes a first pipe section and a second pipe section. The heat engine includes a first piston disposed within the first pipe section. The heat engine includes a second piston disposed within the second pipe section. The first and second pistons are magnetically linked to travel along the continuous internal path of the pipe.

20 Claims, 21 Drawing Sheets

HEAT ENGINE WITH MAGNETICALLY LINKED PISTONS

CROSS-REFERENCE TO RELATED APPLICATIONS

This application claims the benefit of U.S. Provisional Patent Application No. 63/168,563, which was filed on Mar. 31, 2021. The entire content of the foregoing provisional application is incorporated herein by reference.

TECHNICAL FIELD

The present disclosure relates generally to heat engines. More specifically, the present disclosure relates to heat engines including magnetically coupled and/or linked pistons that provide improved efficiency and effectiveness in operation.

BACKGROUND

A variety of engine designs are used in the industry to convert heat to work, or work to heat transfer. Such engines can use the process of compression, heat addition, expansion of a working fluid, and/or heat rejection. As an example, some traditional engines use a mechanical compressor and expander to perform the thermodynamic cycles. However, based on the design of traditional engines, the process can lack efficiency and effectiveness, resulting in significant energy losses.

SUMMARY

In accordance with embodiments of the present disclosure, an exemplary heat engine is provided that includes magnetic or electromagnetically driven and linked pistons that significantly improve the efficiency and effectiveness of engine operation. As used herein, the term "heat engine" refers to a heat engine, a heat pump, a thermal energy conversion device, combinations thereof, or the like. The pistons traverse mechanical cylinder chamber topologies in a magnetically coupled and/or linked manner to continuously and cyclically perform the compression and expansion cycles, providing for an increase in the thermal to work conversion performance. Operation of the exemplary heat engine can further economic viability and climate impact reductions in a variety of technology sectors.

In accordance with embodiments of the present disclosure, an exemplary heat engine is provided. The heat engine includes a pipe that defines a continuous internal path. The pipe includes a first pipe section and a second pipe section. The heat engine includes a first piston disposed within the first pipe section. The heat engine includes a second piston disposed within the second pipe section. The first and second pistons are magnetically linked to travel along the continuous internal path of the pipe.

In some embodiments, the first pipe section includes a first end and an opposing second end, and the second pipe section includes a first end and an opposing second end. In some embodiments, the first end of the first pipe section is connected to the second end of the second pipe section, and the first end of the second pipe section is connected to the second end of the first pipe section. In some embodiments, the heat engine can include a third pipe section including a first end and an opposing second end. In such embodiments, the first end of the first pipe section can be connected to the second end of the third pipe section, and the first end of the second pipe section can be connected to the second end of the third pipe section. The first, second and third pipe sections thereby define the continuous internal path.

The heat engine can include an external driving mechanism configured to generate electromagnetic forces to drive the magnetically linked travel of the first and second pistons along the continuous internal path of the pipe. In some embodiments, the external driving mechanism can include coil windings disposed around the first and second sections of the pipe.

In some embodiments, the first pipe section can define a first loop of the pipe and the second pipe section can define a second loop of the pipe. In such embodiments, the first and second loops traverse along a shared (or substantially shared) plane. In some embodiments, the first pipe section can define a loop of the pipe and the second pipe section can define a helical pathway around the loop formed by the first pipe section. In such embodiments, the helical pathway can define a longer pathway than a pathway of the loop. In such embodiments, during the magnetically linked travel of the first and second pistons along the continuous internal path of the pipe, a speed of the first or second piston traveling through the helical pathway is greater than a speed of the first or second piston traveling through the loop.

In one complete cycle, the first piston travels along the continuous internal path through the first pipe section, into the second pipe section, through the second pipe section, and back to the first pipe section. Simultaneously, in the one complete cycle, the second piston travels along the continuous internal path through the second pipe section, into the first pipe section, through the first pipe section, and back to the second pipe section. The first and second pistons remain magnetically linked during travel through the respective first and second pipe sections.

The pipe can be fabricated from a non-magnetic material. The first and second pistons can be fabricated from a magnetic material. In some embodiments, ferrofluid can be disposed within the continuous internal path of the pipe. The ferrofluid can provide a dynamic seal and/or bearing effect between an inner surface of the pipe and the respective first and second pistons. The magnetically linked travel of the first and second pistons along the continuous internal path of the pipe achieves continuous (or substantially continuous) compression and expansion cycles. In some embodiments, the first pipe section can define a diameter greater than a diameter of the second pipe section. In some embodiments, the heat engine can include a hot heat exchanger fluidly connected to the first pipe section at or near the first and opposing second ends. In some embodiments, the heat engine can include a cold heat exchanger fluidly connected to the second pipe section at or near the first and opposing second ends.

In accordance with embodiments of the present disclosure, an exemplary method of operating a heat engine is provided. The method includes driving travel of a first piston and a second piston of a heat engine along a continuous internal path of a pipe. The heat engine includes the pipe that defines the continuous internal path. The pipe includes a first pipe section and a second pipe section. The heat engine includes the first piston disposed within the first pipe section. The heat engine includes the second piston disposed within the second pipe section. The method includes maintaining the first and second piston magnetically linked to each other during travel along the continuous internal path of the pipe.

In one complete cycle, the first piston travels along the continuous internal path through the first pipe section, into the second pipe section, through the second pipe section, and back to the first pipe section. Simultaneously, in the one complete cycle, the second piston travels along the continuous internal path through the second pipe section, into the first pipe section, through the first pipe section, and back to the second pipe section. The first and second pistons remain magnetically linked during travel through the respective first and second pipe sections.

Other features and advantages will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed heat engine, reference is made to the accompanying figures, wherein.

DETAILED DESCRIPTION

Figure 1:
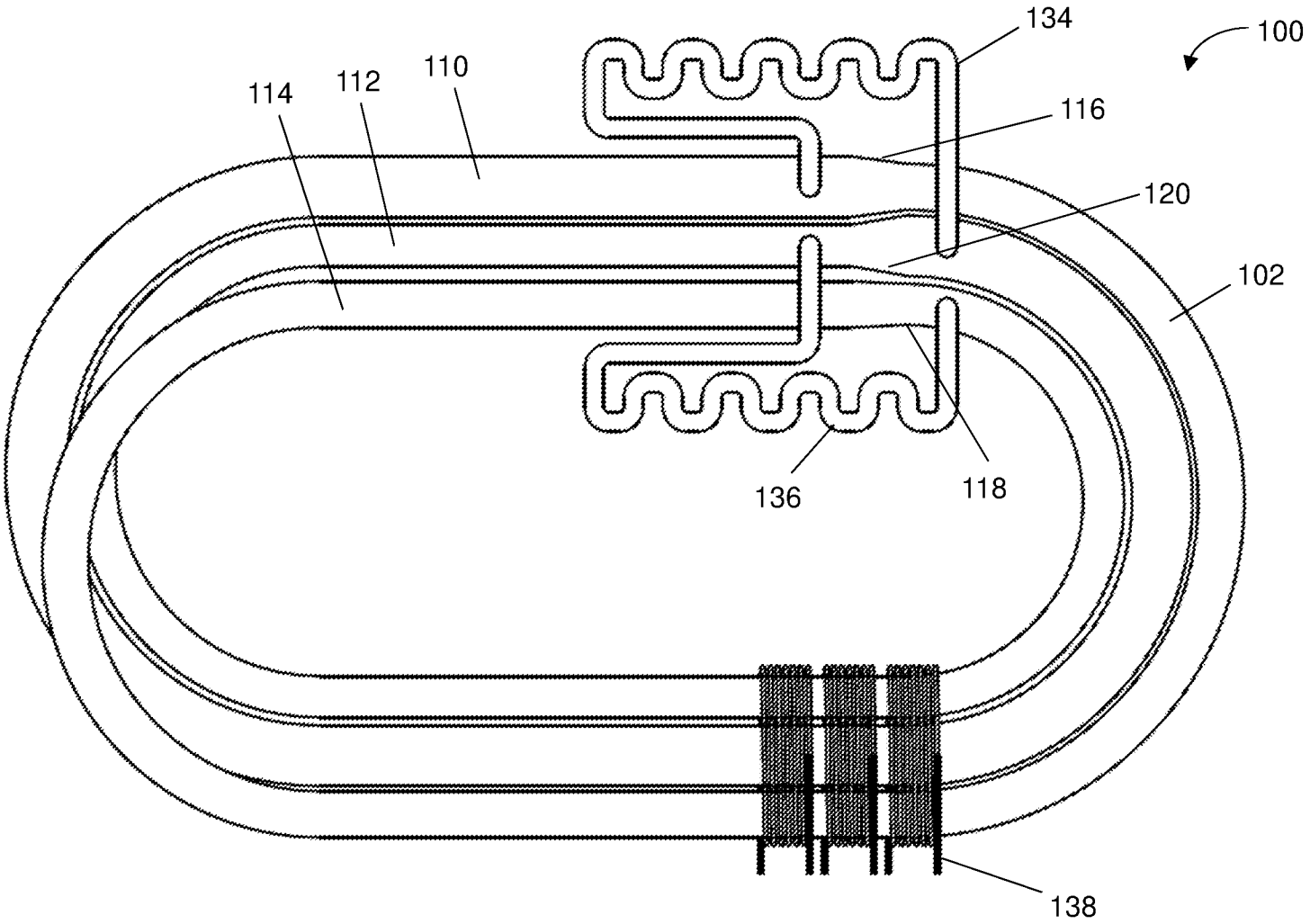
FIG. 1 is a top diagrammatic view of an exemplary heat engine in accordance with the present disclosure.
Figure 2:
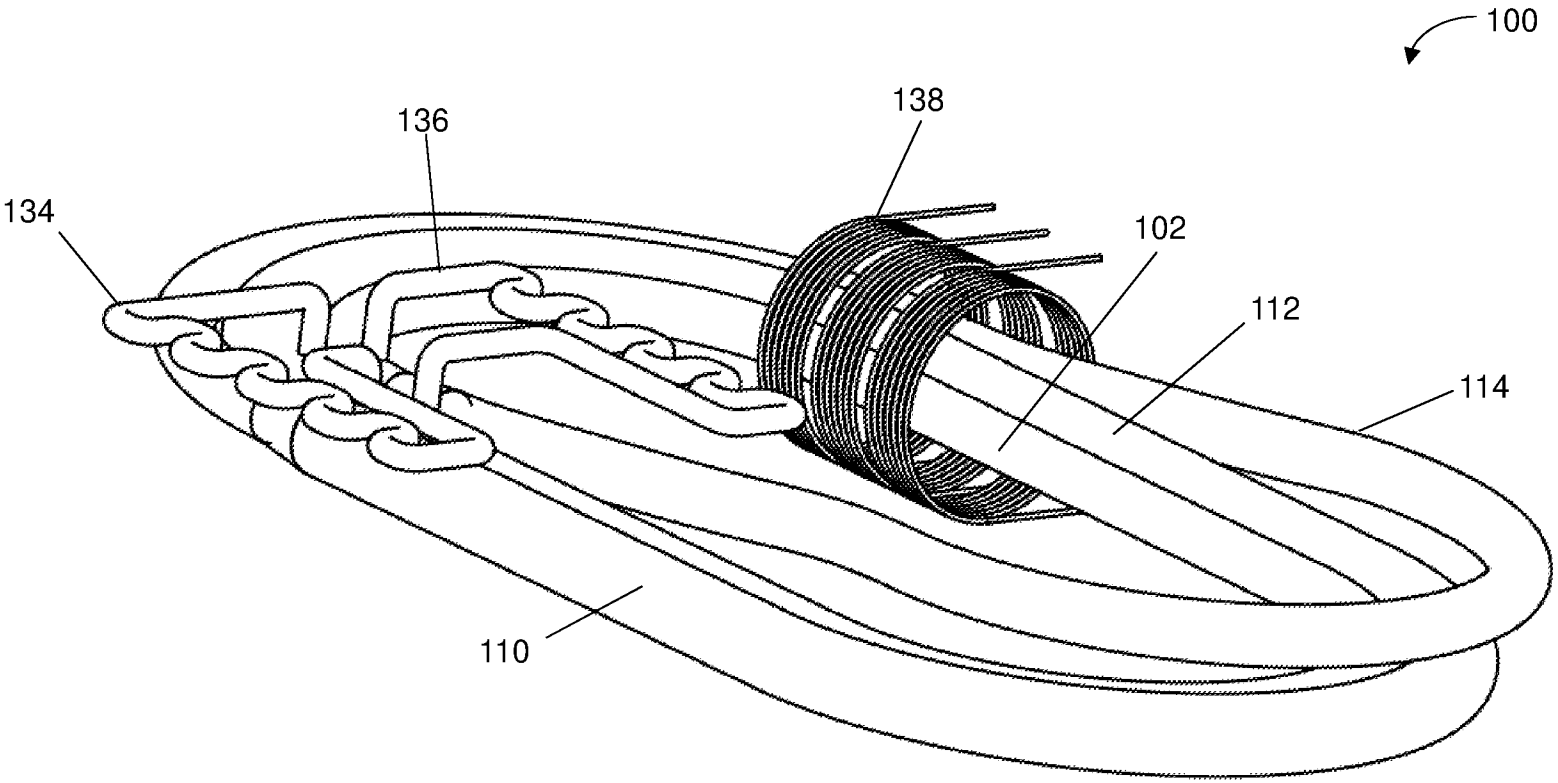
FIG. 2 is a perspective diagrammatic view of the exemplary heat engine of FIG. 1.
Figure 3:
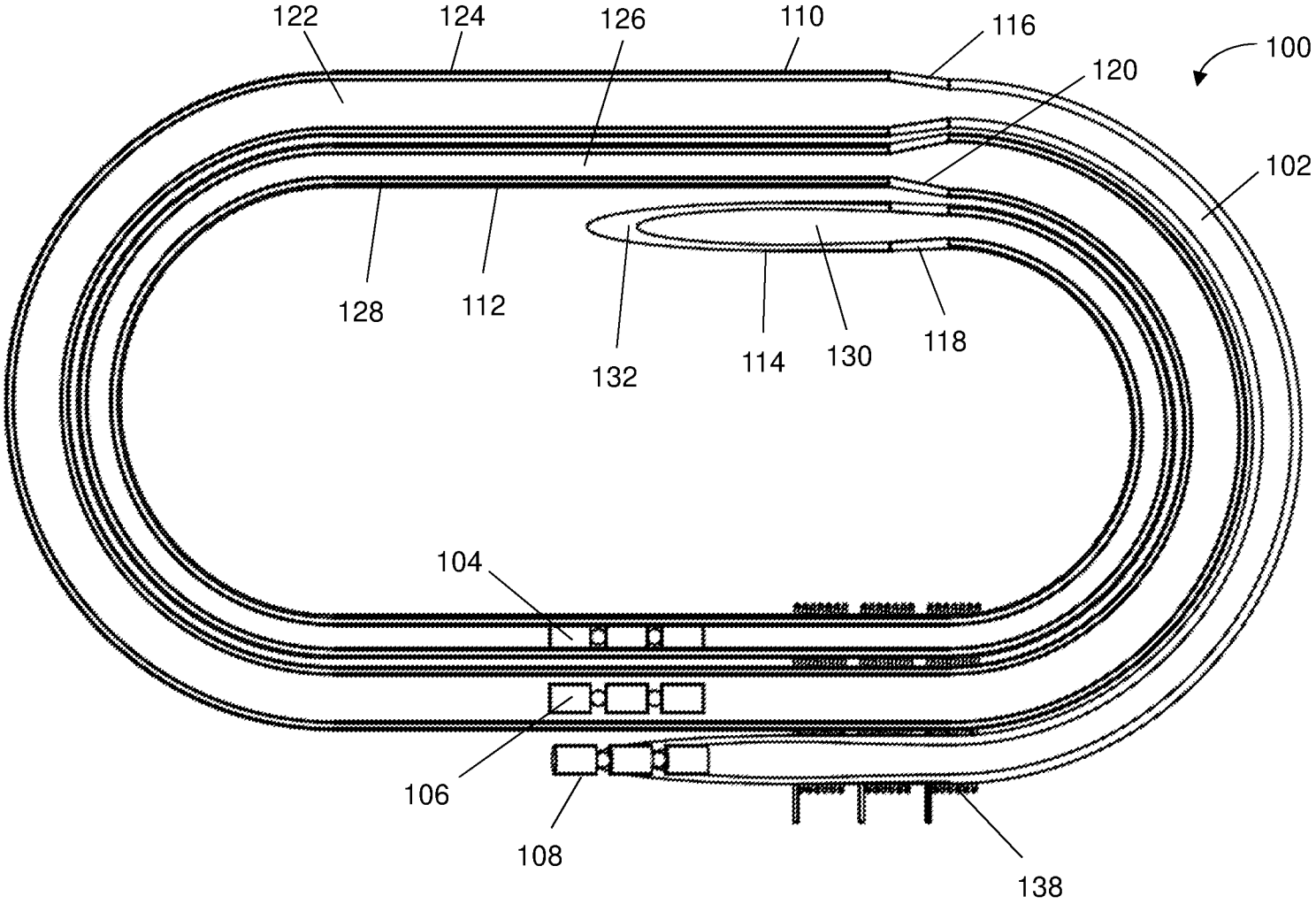
FIG. 3 is a top, cross-sectional diagrammatic view of the exemplary heat engine of FIG. 1.
Figure 4:
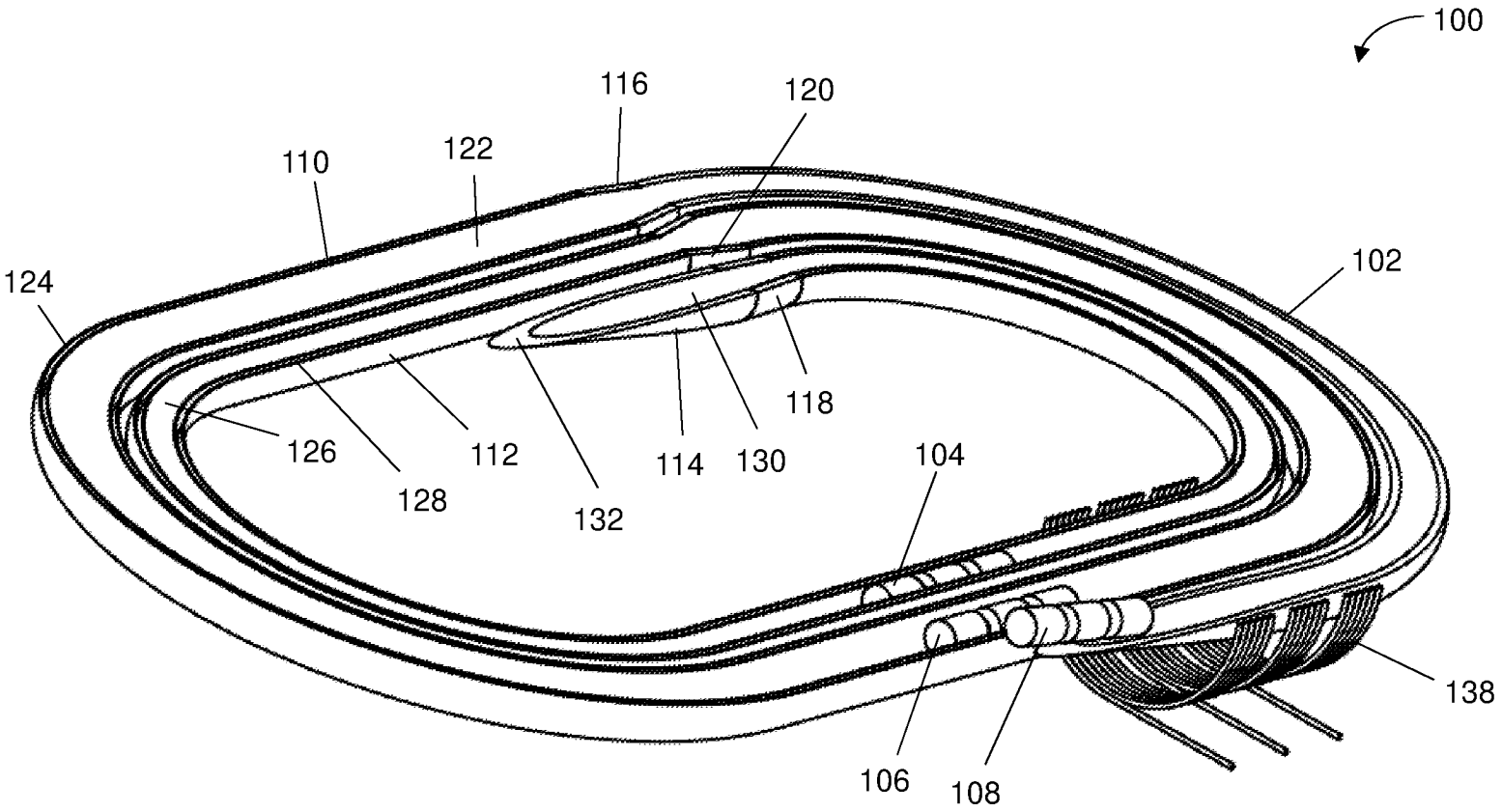
FIG. 4 is a perspective, cross-sectional diagrammatic view of the exemplary heat engine of FIG. 1.
Figure 5:
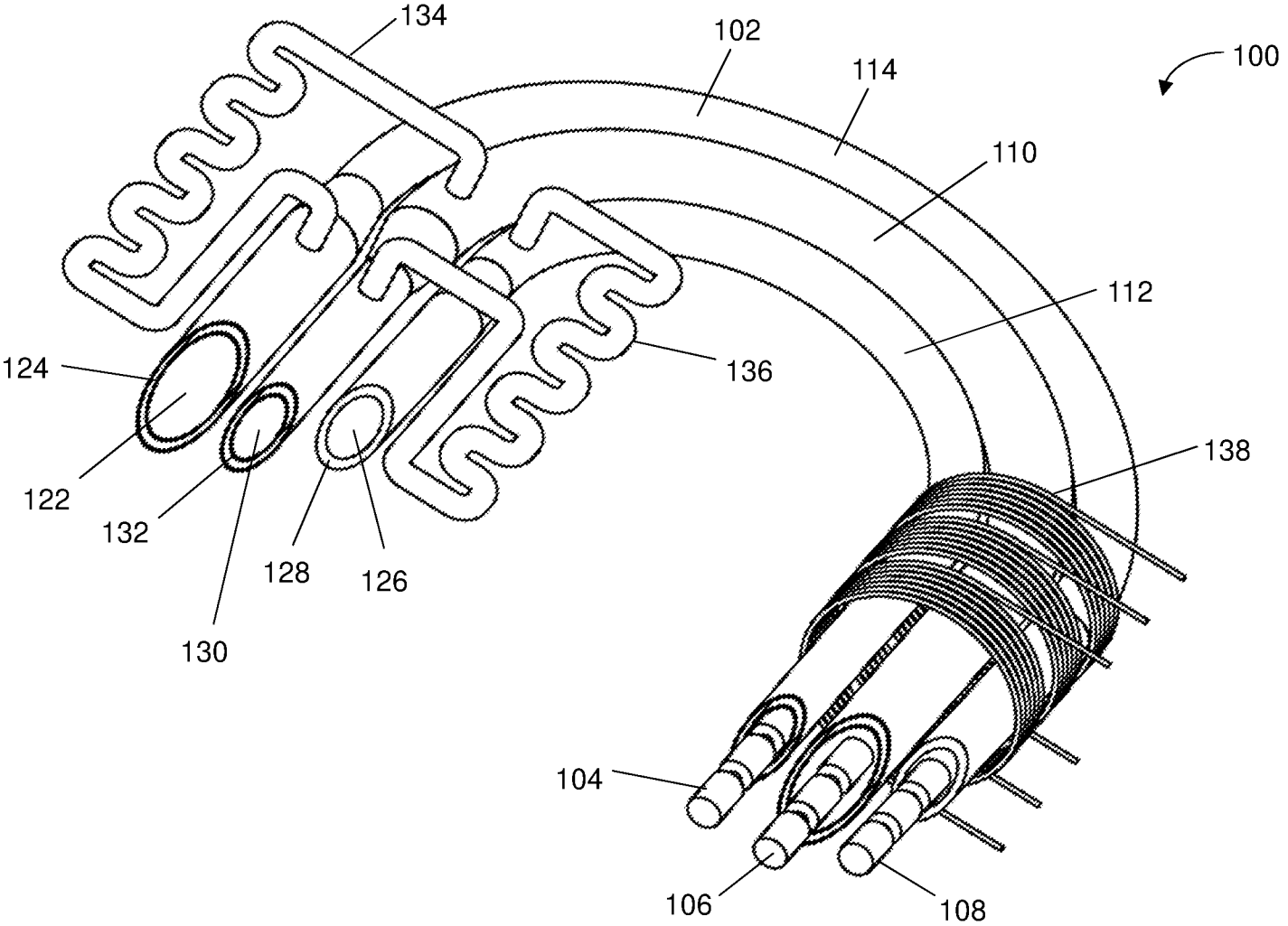
FIG. 5 is a cross-sectional diagrammatic view of the exemplary heat engine of FIG. 1.
Figure 6:
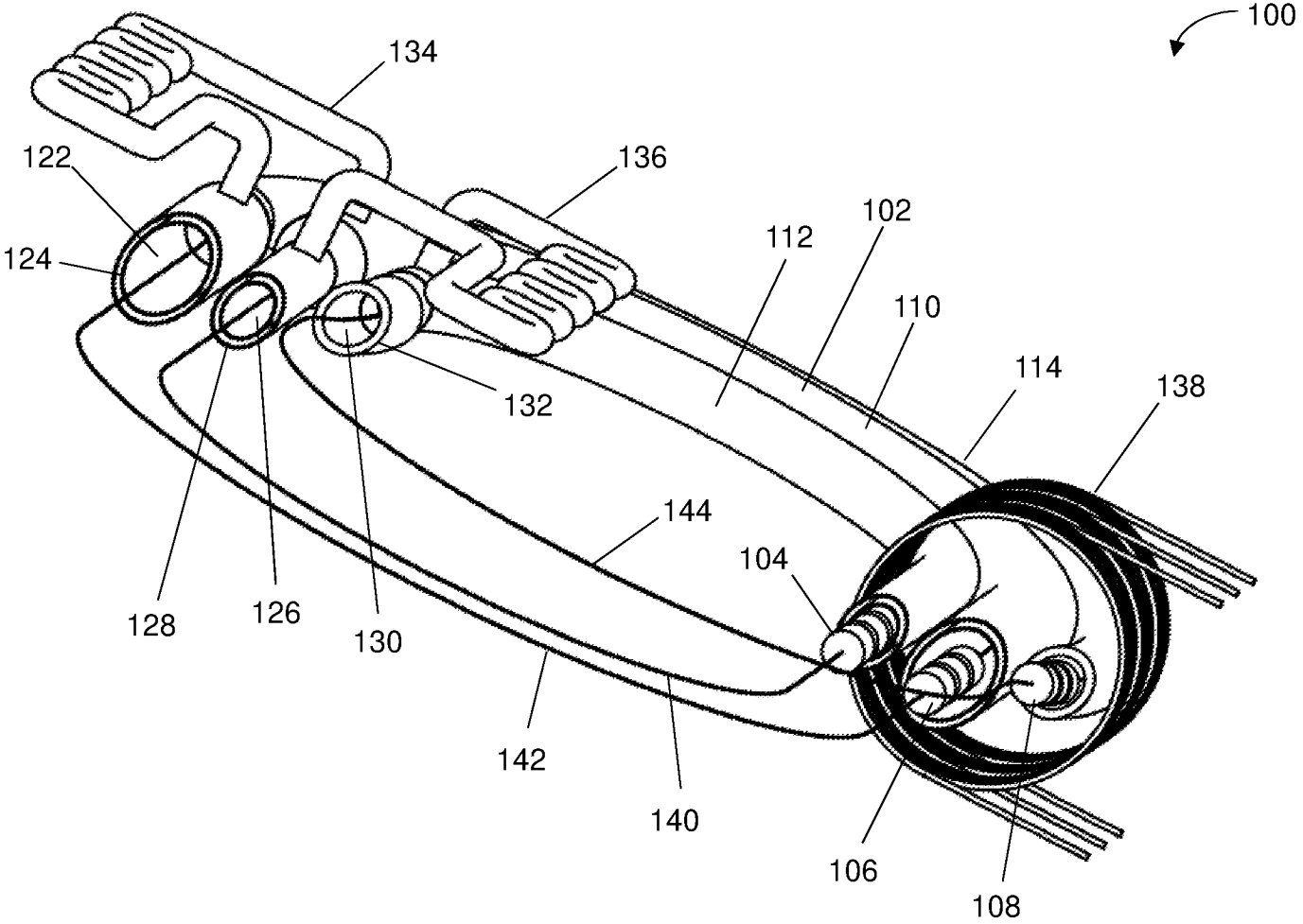
FIG. 6 is a cross-sectional diagrammatic view of the exemplary heat engine of FIG. 1, including piston pathways.
Figure 7:
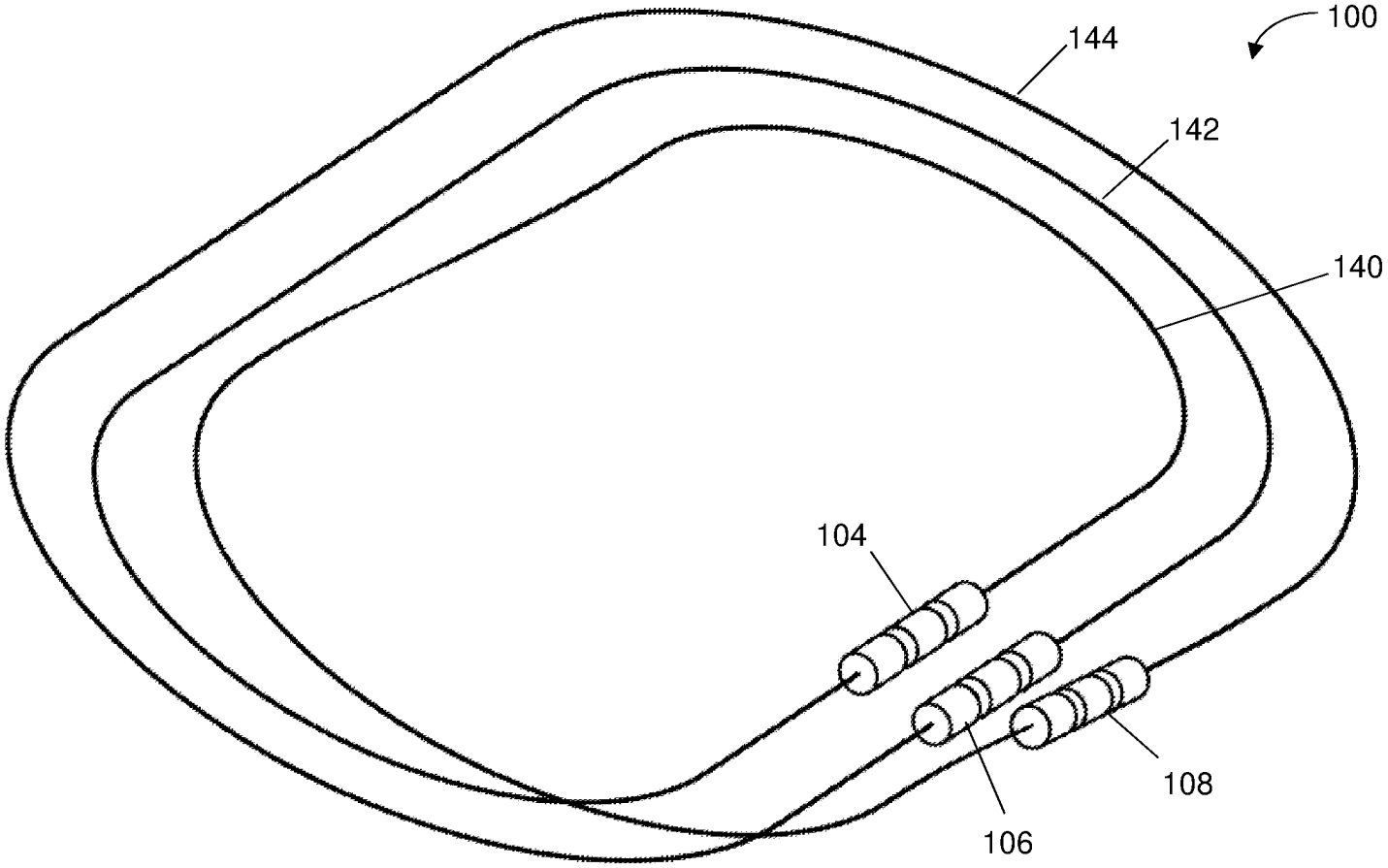
FIG. 7 is a perspective diagrammatic view of piston pathways of the exemplary heat engine of FIG. 1.
Figure 8:
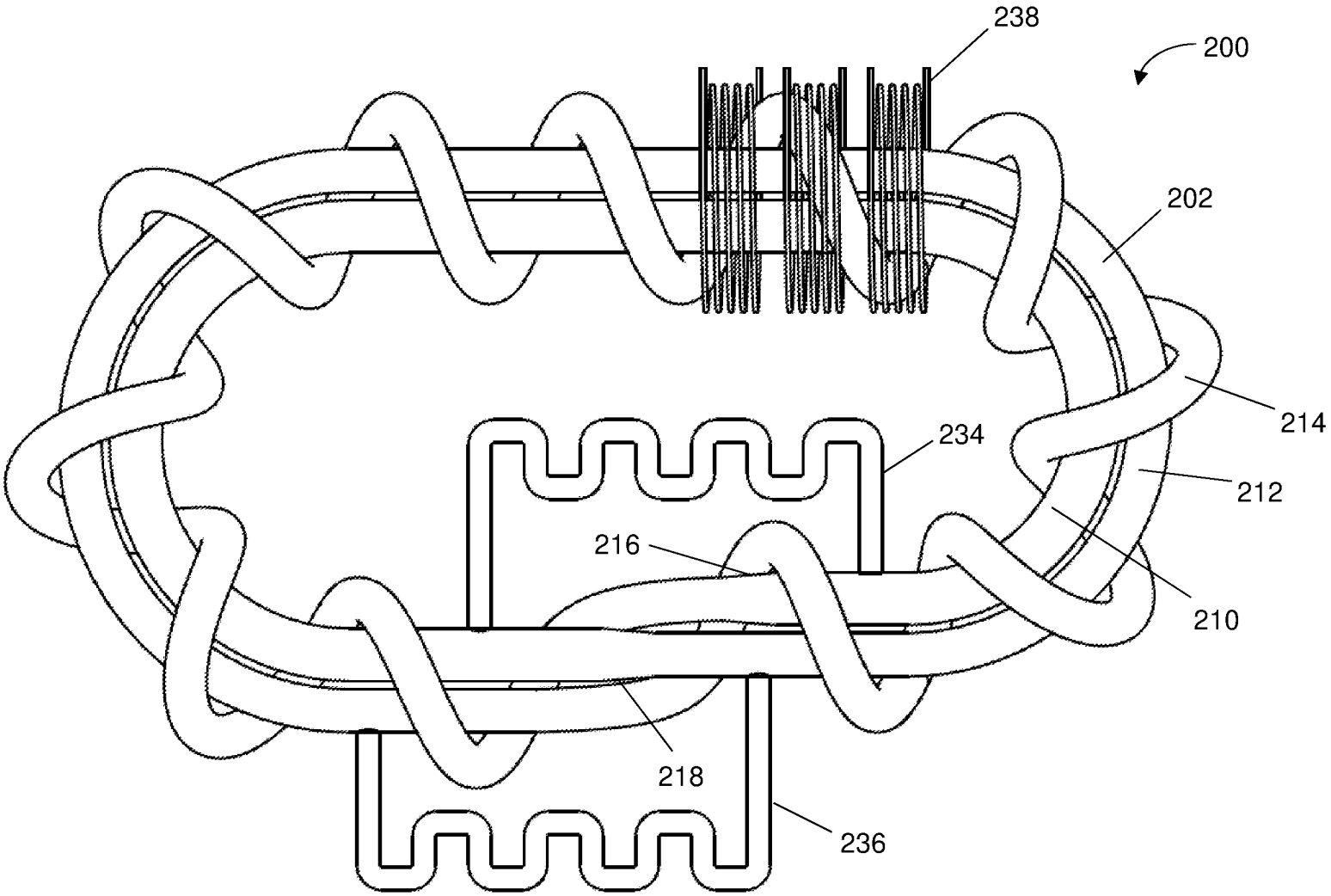
FIG. 8 is a top diagrammatic view of an exemplary heat engine in accordance with the present disclosure.
Figure 9:
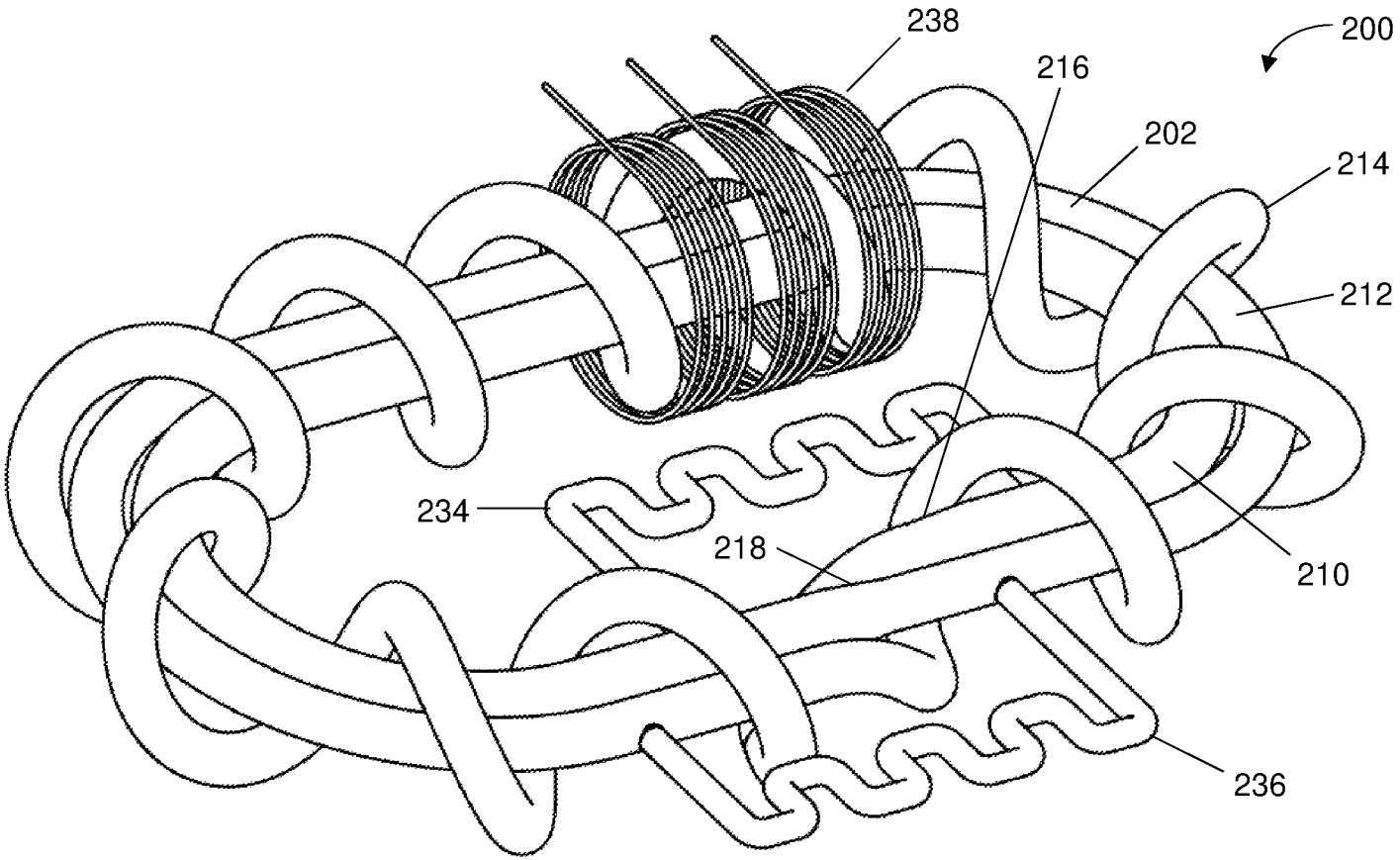
FIG. 9 is a perspective diagrammatic view of the exemplary heat engine of FIG. 8.
Figure 10:
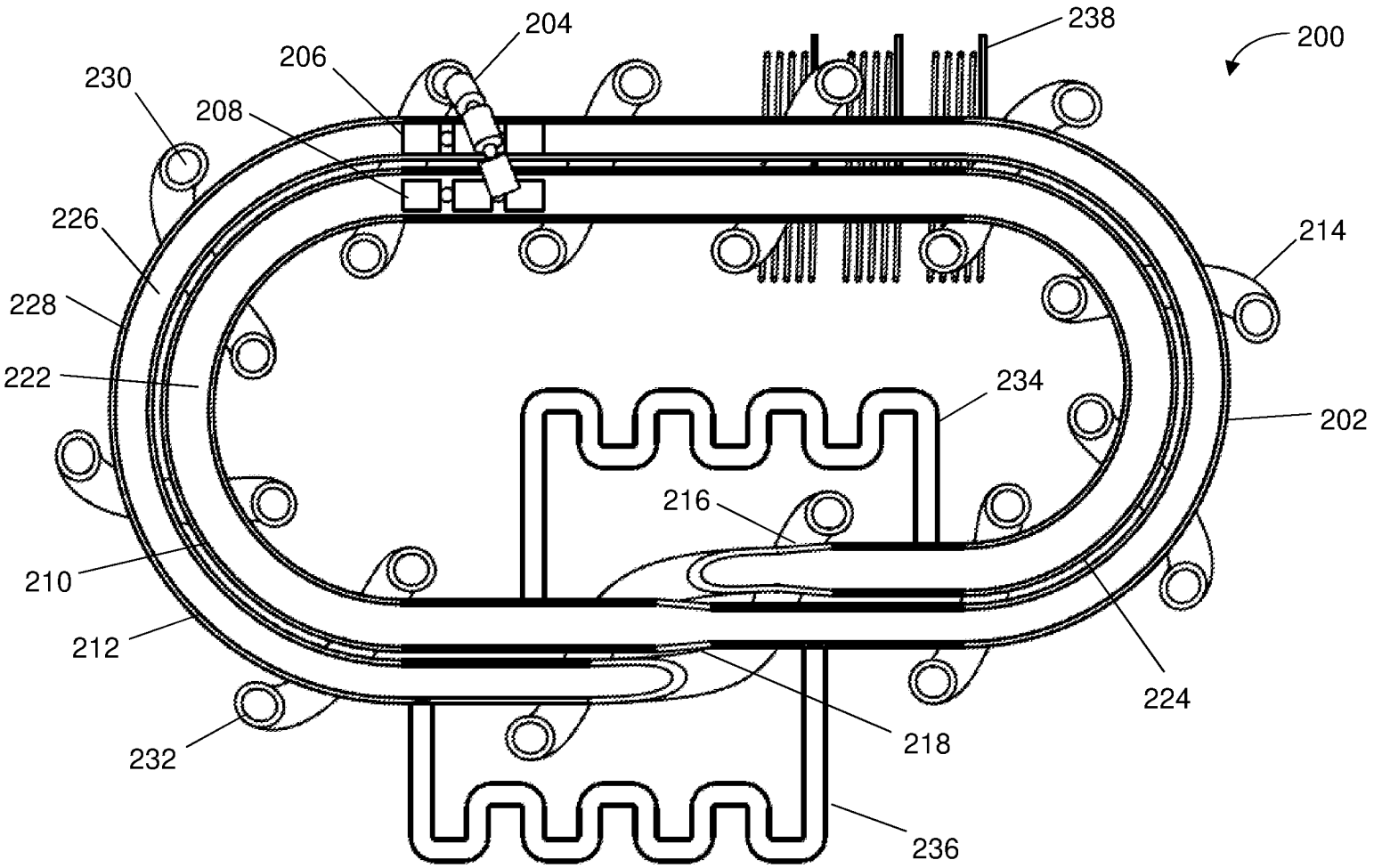
FIG. 10 is a top, cross-sectional diagrammatic view of the exemplary heat engine of FIG. 8.
Figure 11:
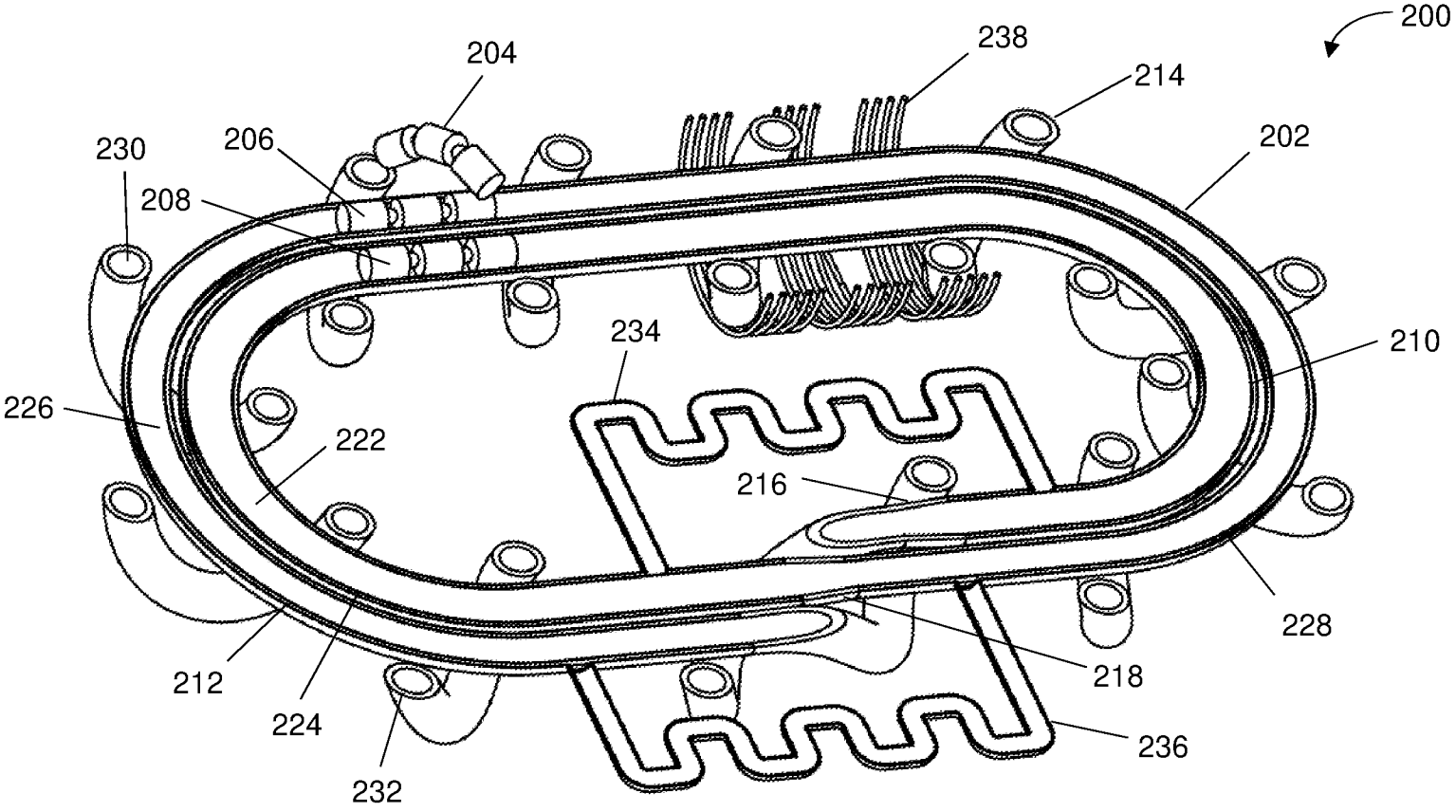
FIG. 11 is a perspective, cross-sectional diagrammatic view of the exemplary heat engine of FIG. 8.
Figure 12:
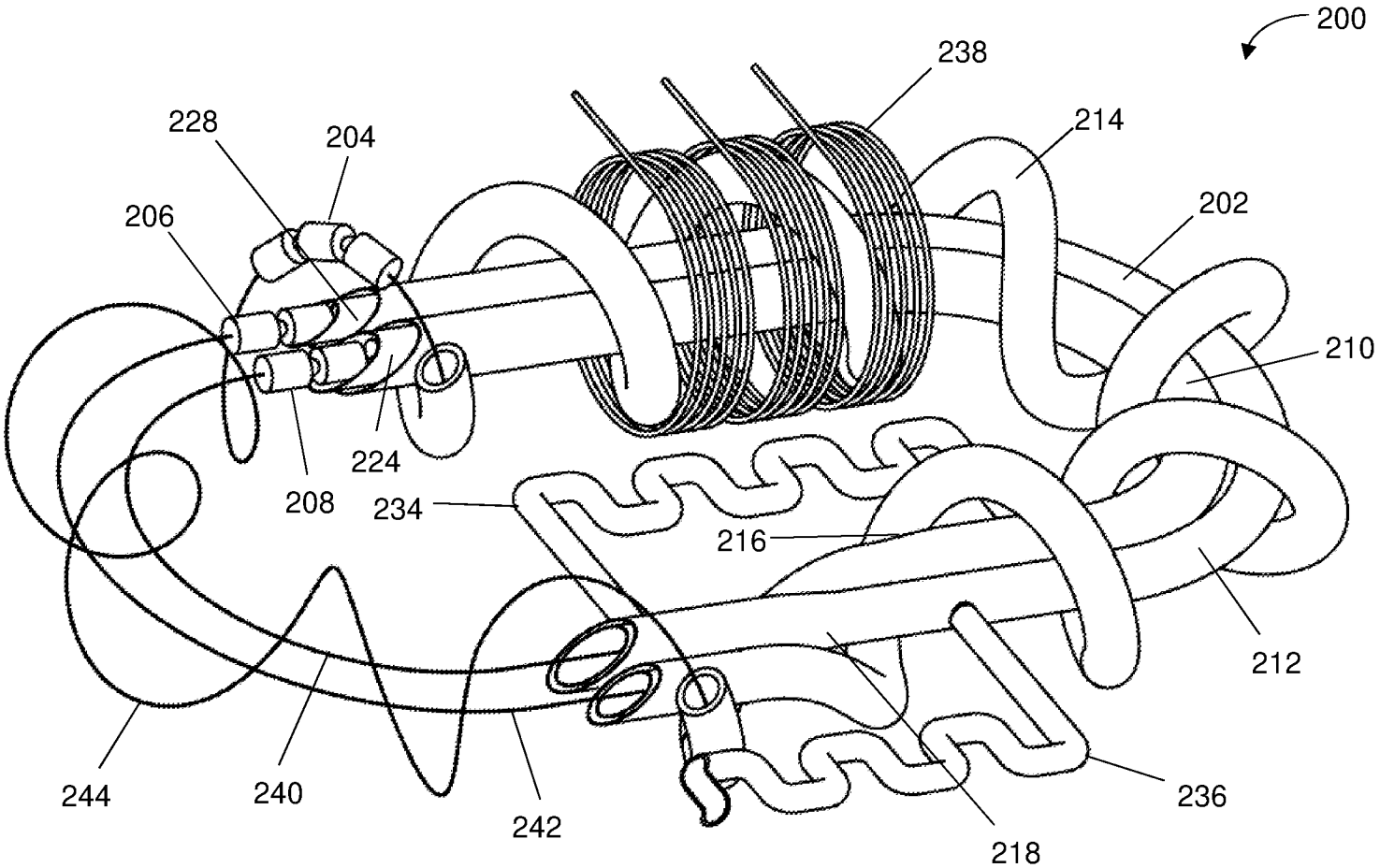
FIG. 12 is a cross-sectional diagrammatic view of the exemplary heat engine of FIG. 8, including piston pathways.
Figure 13:
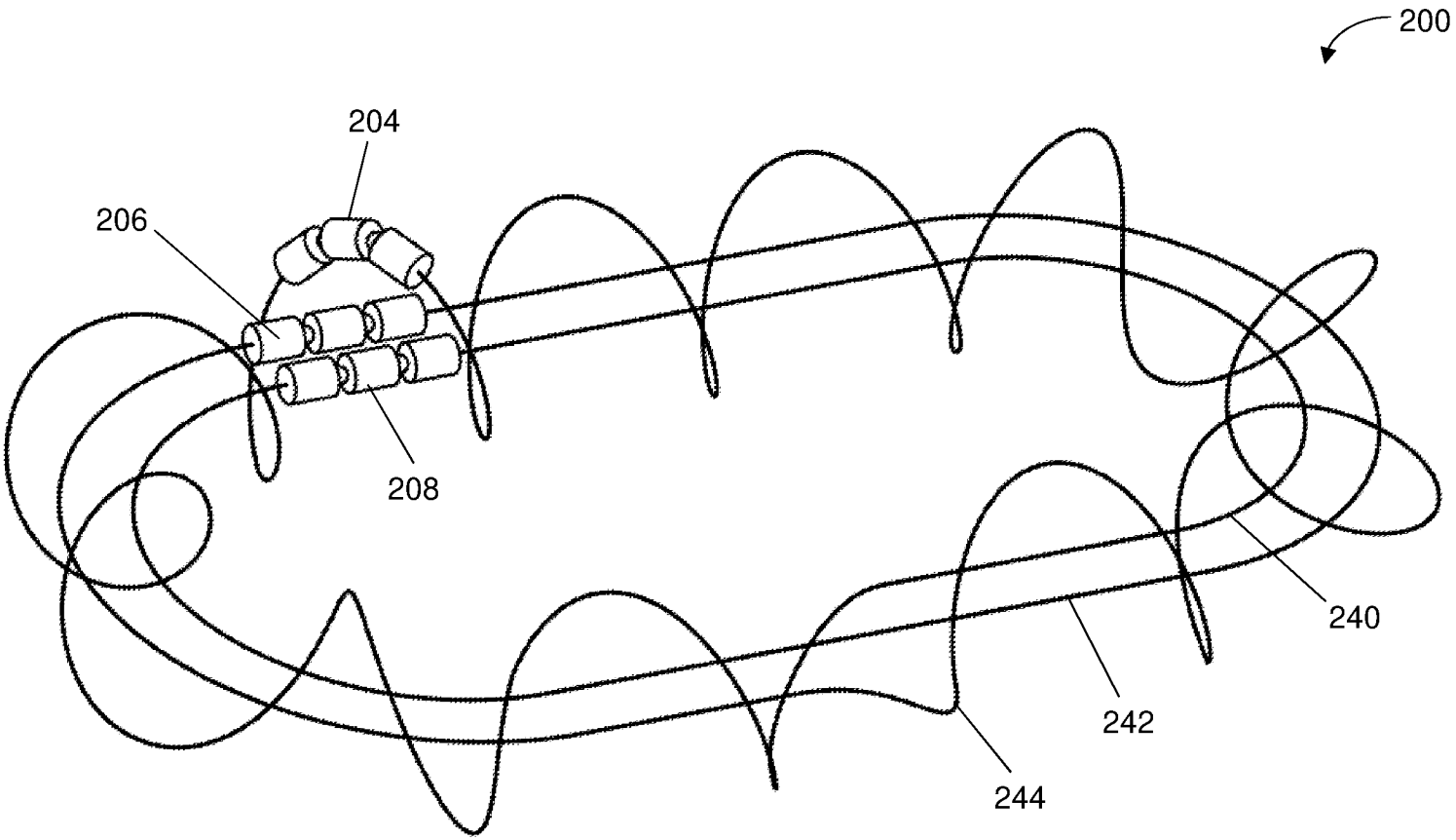
FIG. 13 a perspective diagrammatic view of piston pathways of the exemplary heat engine of FIG. 8.
Figure 14:
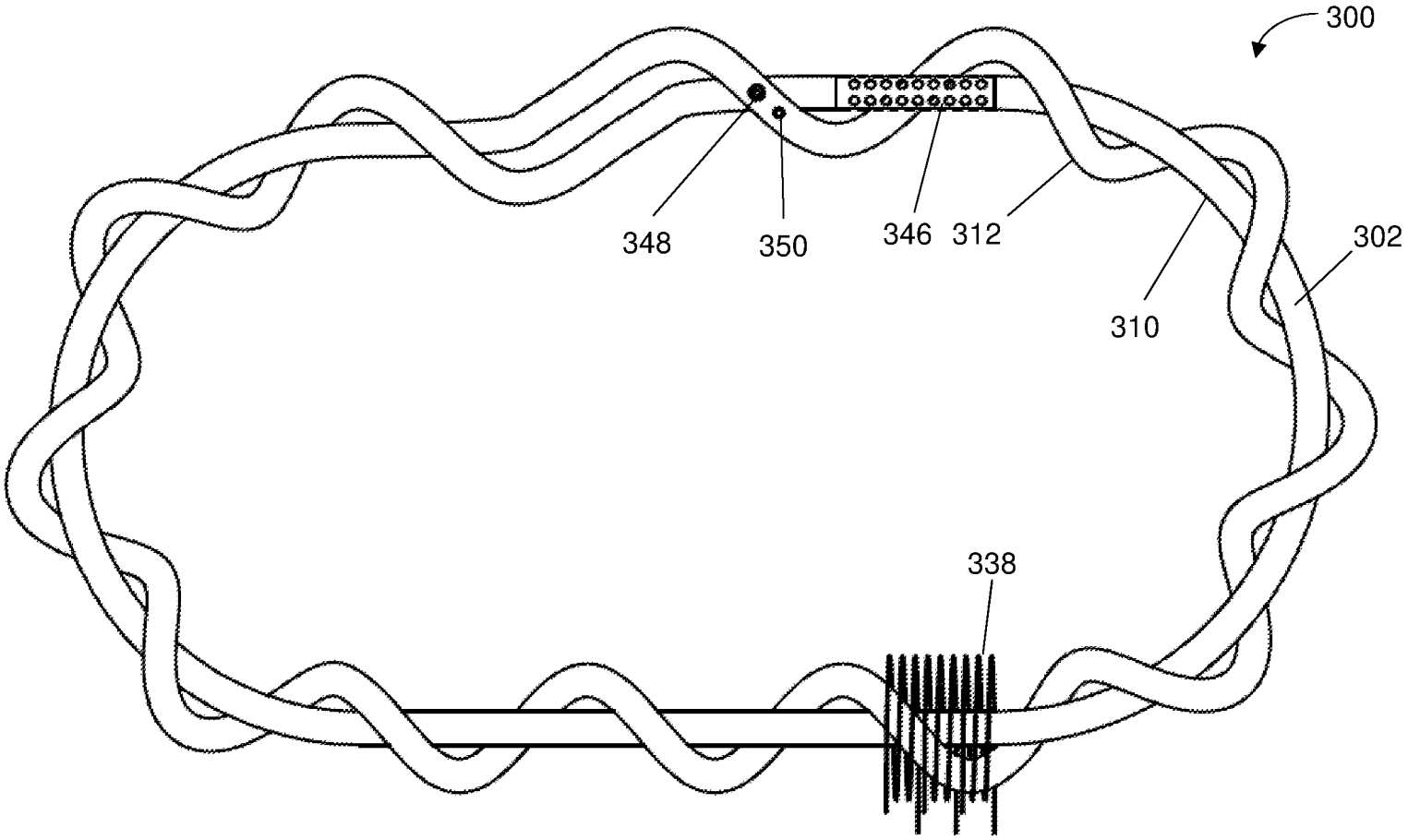
FIG. 14 is a top diagrammatic view of an exemplary heat engine in accordance with the present disclosure.
Figure 15:
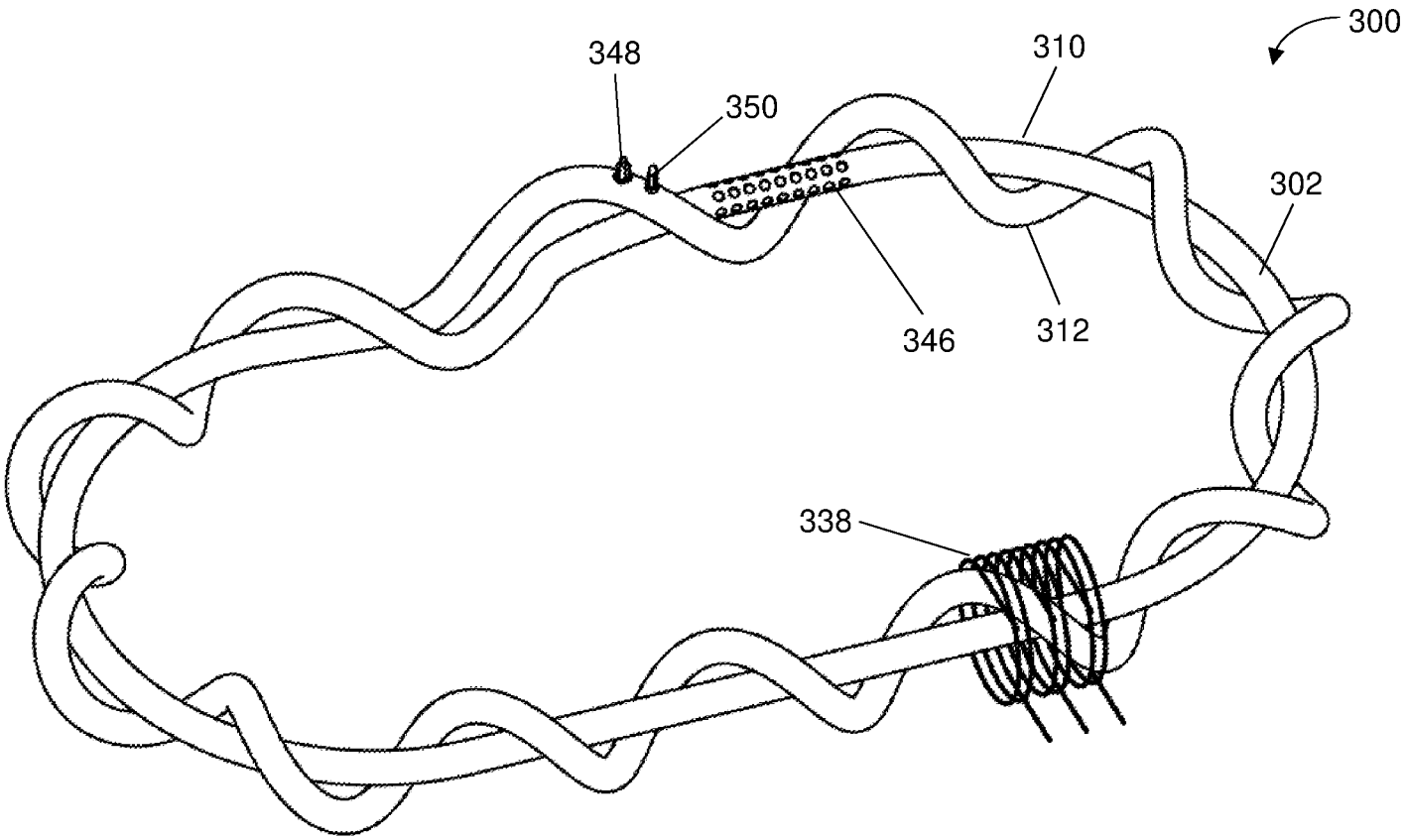
FIG. 15 is a perspective diagrammatic view of the exemplary heat engine of FIG. 14.
Figure 16:
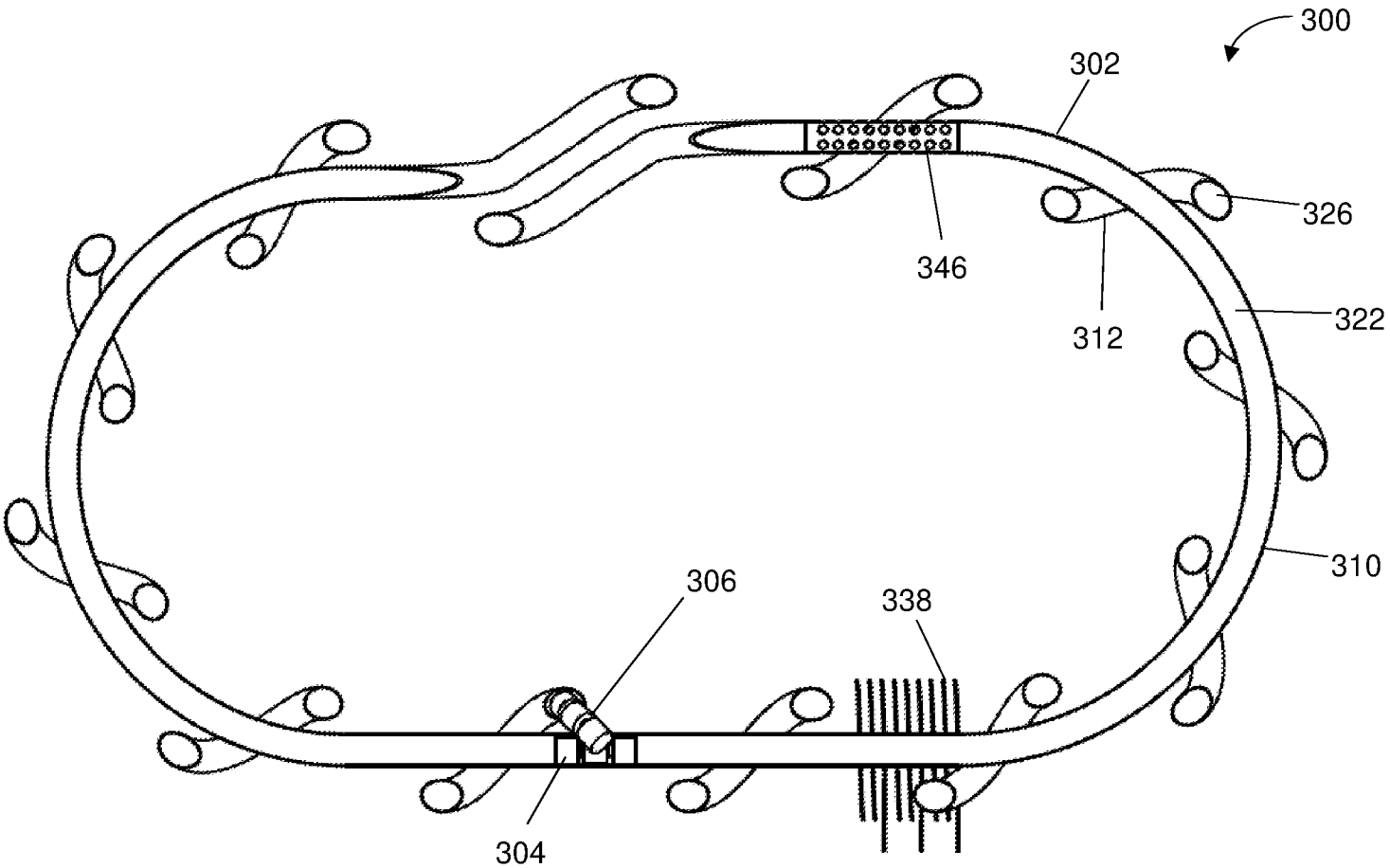
FIG. 16 is a top, cross-sectional diagrammatic view of the exemplary heat engine of FIG. 14.
Figure 17:
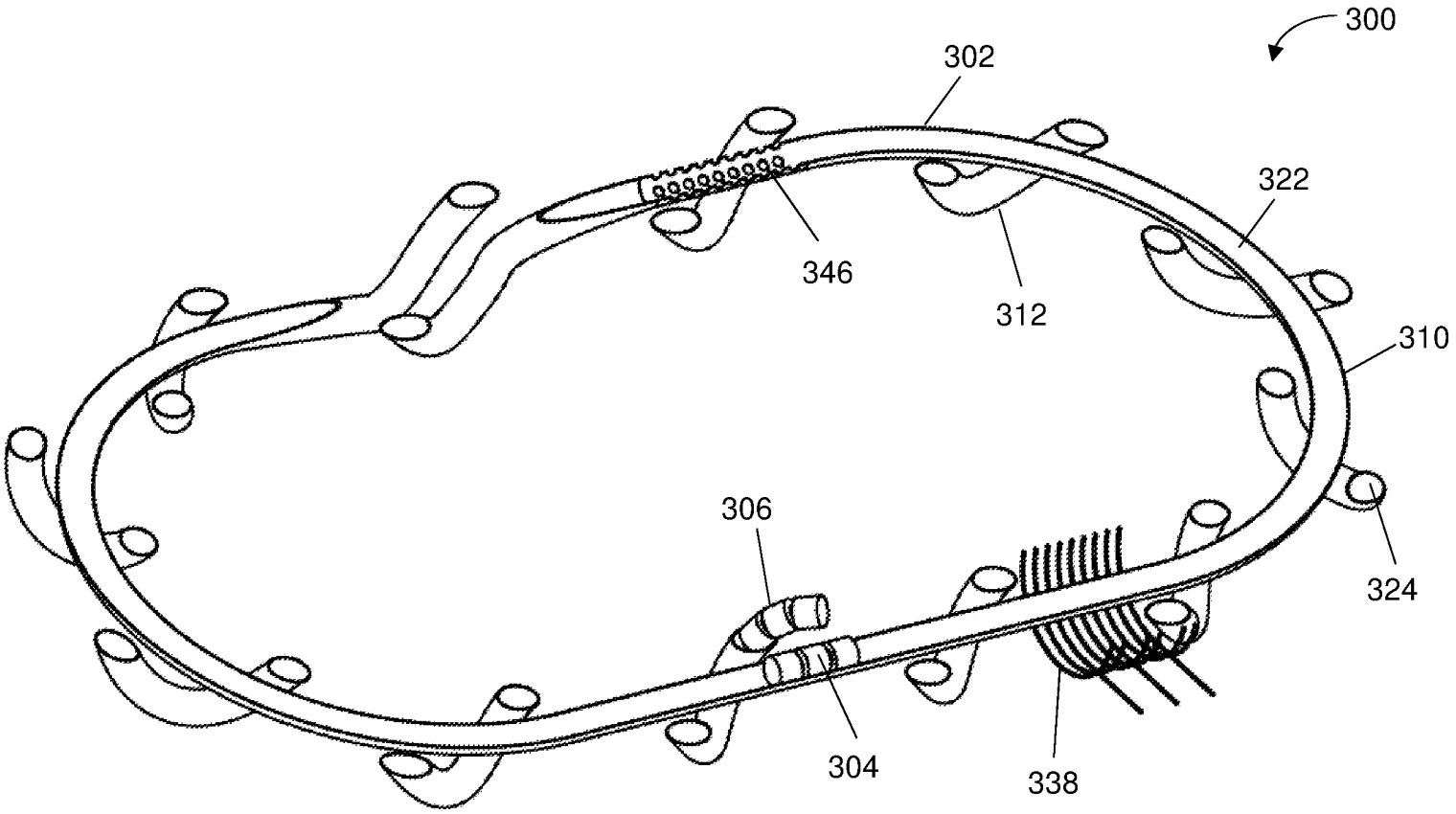
FIG. 17 is a perspective, cross-sectional diagrammatic view of the exemplary heat engine of FIG. 14.
Figure 18:
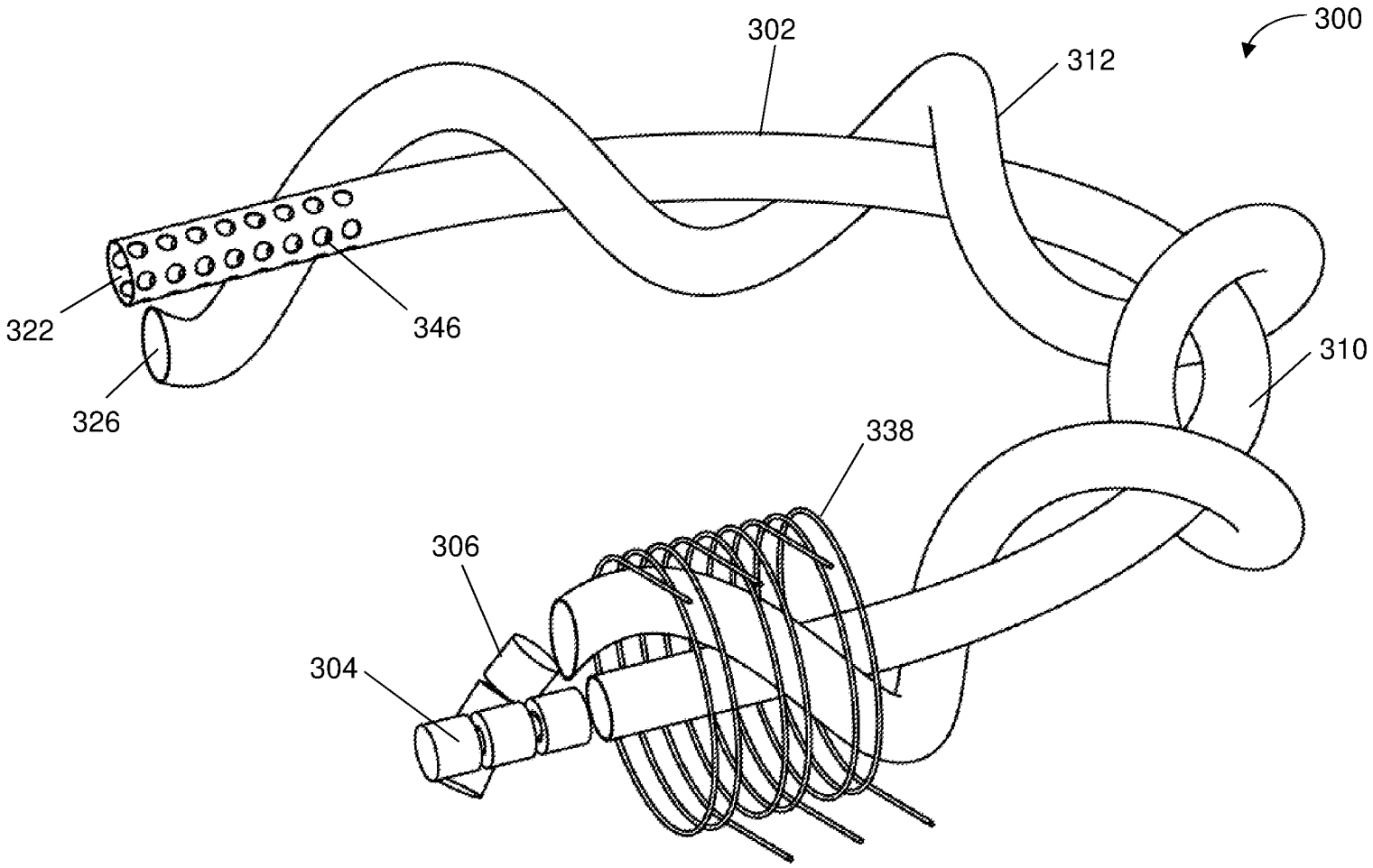
FIG. 18 is a cross-sectional diagrammatic view of the exemplary heat engine of FIG. 14.
Figure 19:
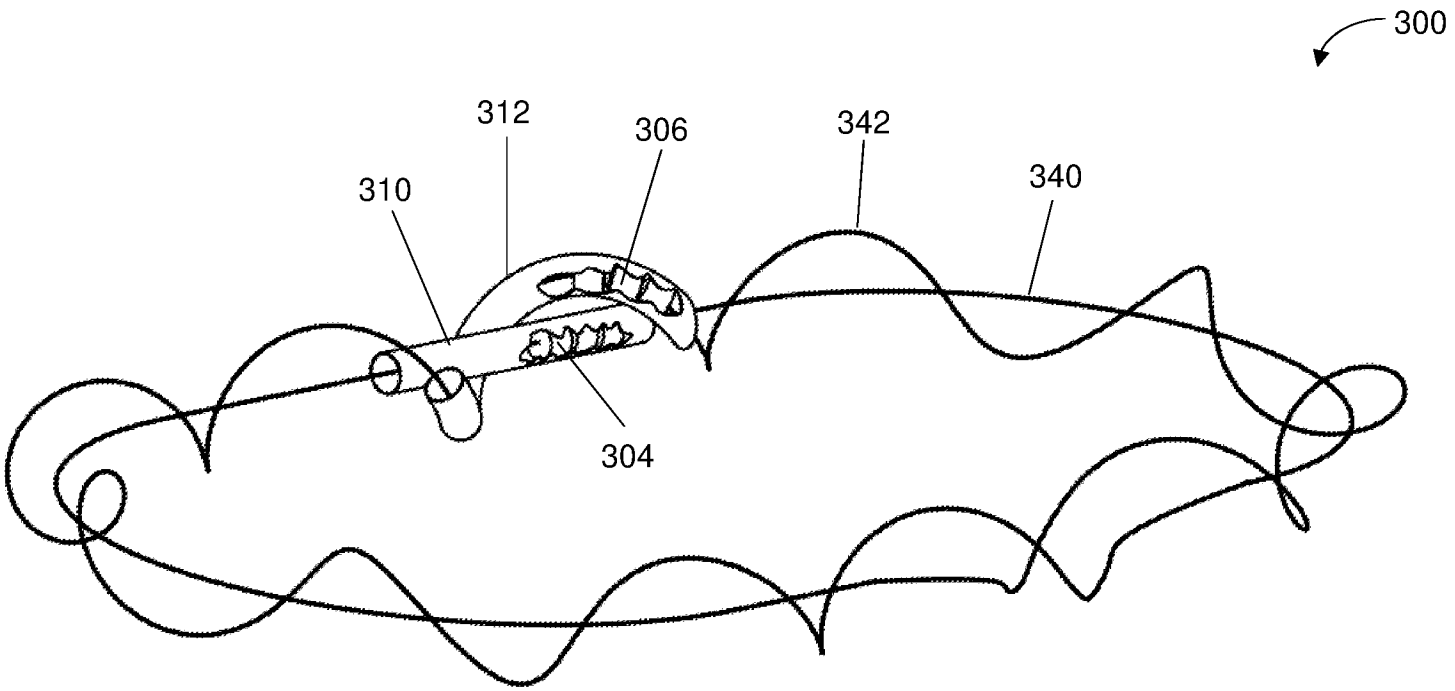
FIG. 19 is a perspective diagrammatic view of piston pathways of the exemplary heat engine of FIG. 14.

The exemplary heat engines discussed herein provide significant advantages to operational efficiency and effectiveness as compared to traditional heat engines. Although discussed herein as a heat engine, it should be understood that the exemplary systems can be configured or reconfigured as a heat engine, a heat pump, or a thermal energy conversion device. In some embodiments, one or more of the pipe sections or components can be combined to form a machine capable of acting simultaneously as a heat engine and a pump. The heat engine includes magnetically coupled and/or linked pistons that continuously operate compression and expansion cycles in an efficient manner. The heat engine thereby defines a magnetically linked free piston machine, a more effective heat engine, allowing a closer following of the thermodynamic ideal. One of the enabling kinematic principles used by the heat engine can be separate but magnetically or electromagnetically linked mechanically advantaged free pistons traversing in closely following parallel (or substantially parallel) cylinder chambers. The pistons can continuously and unidirectionally revolve in contiguous cylinder bore loops acting in one section of the heat engine as a compressor and in another section of the heat engine as an expander. Heat addition or rejection can occur by a large conductive exchange surface area from significantly elongated piston cylinders of unrestricted stroke length. The heat engine can form a closed cycle machines (or a substantially closed cycle machine) with highly pressurized working gas or an open cycle designs of internal combustion with air induction and exhaust. Different processes of mechanical advantage can be used by the heat engine to achieve expansion chamber work driving compression. In some embodiments, a differential bore diameter (where the cylinder chamber compression bore is dimensioned smaller than the expansion bore) can be used, e.g., with low expansion ratios. In some embodiments, a straight fixed compression cylinder chamber bore can be surrounded by a helical screw-like expansion cylinder bore path, which can be used with, e.g., large expansion ratios.

The magnetically linked free-piston can be used to expand the possibilities in engine functionality advancement. Near or quasi-isothermal compression and expansion without loss compounding stages can be achievable in low power-to-weight ratio designs, enhancing work output by more closely following thermodynamic ideals. The exemplary heat engine can exhibit characteristics similar to the Brayton cycle of high rate and continuous non-cyclical power output advantages without the high cost and low effectiveness of traditional turbine systems in less than several MW sizes. Recuperation or regeneration can be executed as the heat flow nature in the heat engine is counter current flowed. Unidirectional operation of the working fluid mass with the elimination of thermal short circuit reverse flow can further reduce losses that traditional reciprocating engines may suffer.

The heat engine can emphasize the heat exchanger performance with fully integrated gas working compressor and expander pistons, an inherent linear transiting magnetic flux for electrical generation, and a remarkable heat-to-electricity efficiency given the delta-T utilized. The free-piston magnetic design can also be used as a new type of internal combustion machine suitable for high power-to-weight ratio applications. The exemplary heat engine design provides numerous energy use advancement opportunities in solar, geothermal, waste heat recovery, thermal storage-to power, and possibly transportation. In some embodiments, the heat engine design can assist in reductions of energy-related emissions, including greenhouse gases.

The heat engine is capable of overcoming the Curie temperature barrier of permanent magnetism, which is a limitation of the heat engine's working temperature. As a magnetic piston travels in the heat engine, the piston can arrive at a mean temperature based on the transit length of the heat exchange chambers. Increased cold side length exchange can allow higher delta-Ts by lower mean magnetic piston temperature. In some embodiments, the heat engine can be based on an exclusively electromagnetic principle. Extreme temperatures suitable particularly for an internal combustion machine can be achievable as electromagnetic inductive coils to not suffer magnetic flux output degradation, with the conductive resistance increasing instead. Electromagnetic induction can serve the engine's workings as compared to permanent magnets, while also providing far greater magnetic flux strength. The heat engine design can minimize the magnetic field air gap while balancing insulating hot and cold sections. Creative engineering solutions in the three-dimensional back iron magnetic flux guide(s) can be used. The heat engine design further overcomes the difficulty in achieving magnetic flux density cross-section for high power outputs through plural cylinder path flux linking geometries.

FIGS. 1-7 are diagrammatic top, perspective, cross-sectional and detailed views of an exemplary heat engine 100 (e.g., a differential bore magnetic heat engine system). The heat engine 100 provides for continuous expansion and compression cycles, resulting in higher power-to-weight ratio, output and efficiency. The heat engine 100 includes a single pipe 102 continuously (or substantially continuously) formed to define an internal path along which pistons 104, 106, 108 travel to continuously perform the expansion and compression cycles. The pipe 102 is separated into three distinct sections—a first pipe section 110 (e.g., a hot pipe, a hot major exterior pipe, or the like), a second pipe section 112 (e.g., a cold pipe, a cold minor exterior pipe, or the like), and an intermediary pipe section 114 (e.g., an intermediate pipe, an expansion exterior pipe, or the like).

The pipe sections 110-114 are each formed in loops and are connected at their respective ends to define the continuous internal path. As discussed herein, a linear pathway refers to a pathway that generally extends along the same plane (e.g., along a horizontal plane). Although illustrated as extending along substantially linear pathways, it should be understood that the pipe sections 110-114 could be configured to extend in non-linear pathways. The heat engine 100 includes a first transition 116 between the first pipe section 110 and the intermediary pipe section 114, a second transition 118 between the intermediary pipe section 114 and the second pipe section 112, and a third transition 120 between the second pipe section 112 and the first pipe section 110.

Each transition 116-120 defines a tapered section based on the difference in diameters of the respective pipe sections 110-114. In particular, the first pipe section 110 defines a substantially linear, curved pathway with a first end (e.g., at or near the first transition 116) and a second opposing end (e.g., at or near the third transition 120). The second pipe section 112 defines a substantially linear, curved pathway with a first end (e.g., at or near the third transition 120) and a second opposing end (e.g., at or near the second transition 118). The intermediary pipe section 114 defines a substantially linear, curved pathway with a first end (e.g., at or near the second transition 118) and a second opposing end (e.g., at or near the first transition 116). The intermediary pipe section 114 generally travels along the same plane as the first and second pipe sections 110, 112, except for one portion of the intermediary pipe section 114 that passes over the first and second pipe sections 110, 112 to connect with the second transition 118.

The first pipe section 110 defines a first outer diameter and an internal opening 122 having a first inner diameter. In some embodiments, the first pipe section 110 can include an internal jacket space 124 between the internal opening 122 and the outer surface of the first pipe section 110 to provide an insulating effect for reduction in temperature losses of the working fluid. The second pipe section 112 defines a second outer diameter and an internal opening 126 having a second inner diameter. In some embodiments, the second pipe section 112 can include an internal jacket space 128 between the internal opening 126 and the outer surface of the second pipe section 112. The intermediary pipe section 114 defines a third outer diameter and an internal opening 130 having a third inner diameter. In some embodiments, the intermediary pipe section 114 can include a solid wall 132 between the internal opening 130 and the outer surface of the intermediary pipe section 114. In some embodiments, the solid wall 132 can be replaced with a jacket space similar to the jacket spaces 124, 128 of the first and second pipe sections 110, 112. The jacket spaces 124, 128 can receive a heat transfer fluid pumping therethrough to impair a hot and cold temperature gradient throughout the heat engine 100. A thermal exchange can thereby occur in the pipe sections 110-114 to the enclosed working gas and/or working fluid, with the reverse occurring in a heat pump configuration.

The first inner diameter of the first pipe section 110 (and the outer diameter of the first pipe section 110) is dimensioned greater than the second inner diameter of the second pipe section 112 (and the outer diameter of the second pipe section 112) and the third inner diameter of the intermediary pipe section 114 (and the outer diameter of the intermediary pipe section 114). The third inner diameter of the intermediary pipe section 114 (and the outer diameter of the intermediary pipe section 114) is dimensioned greater than the second inner diameter of the second pipe section 112 (and the outer diameter of the second pipe section 112). The first pipe section 110 thereby defines the greatest internal pathway diameter, the intermediary pipe section 114 defines the next greatest internal pathway diameter, and the second pipe section 112 defines the smallest internal pathway diameter. In some embodiments, second pipe section 112 internal diameter can be half of the internal diameter of the first pipe section 110 diameter, and the intermediary pipe section 114 internal diameter can be ¾ of the first pipe section 110 diameter. However, it should be understood that the dimensional relationships of the pipe section 110-114 diameters (e.g., the diameter ratios) could be varied for optimization of the heat engine 100 operation. The difference in diameters results in a tapered configuration of the respective transitions 116-120. In some embodiments, the heat engine 100 could be designed with only the first pipe section 110 and the second pipe section 112 connected by respective transitions, without including the intermediary pipe section 114. However, the intermediary pipe section 114 can provide for smoother and more efficient expansion of the working fluid.

The heat engine 100 includes a hot heat exchanger 134 fluidly connected at one end to the first pipe section 110 at or near the transition 116 (e.g., downstream of the transition 116), and fluidly connected at an opposing end to the first pipe section at or near the transition 120 (e.g., upstream of the transition 120). The heat engine 100 includes a cold heat exchanger 136 fluidly connected at one end to the second pipe section 112 at or near the transition 120 (e.g., downstream of the transition 120), and fluidly connected at an opposing end to the second pipe section 112 at or near the transition 118 (e.g., upstream of the transition 118).

The heat engine 100 includes one or more coil windings 138 positioned around the pipe sections 110-114. The coil windings 138 can be, e.g., wire coil electric linear generator/ alternator windings fabricated from copper, or the like. The windings 138 can be used as exciter windings by receiving current from an external source (e.g., AC or DC current) to generate electromagnetism to drive movement of each of the pistons 104-108. In some embodiments, the windings 138 can be used or act as a power take-off, an extraction of magnetic piston's kinetic energy of moving the magnetic flux to electricity, exciter and/or induction windings, or the like. The pipe sections 110-114 can be fabricated from a non-magnetic material and/or non-conductive material (e.g., an insulator in the electric sense) to prevent eddy current interference with the pistons 104-108 and windings 138. Although three coil windings 138 are shown in the figures for simplicity, in some embodiments, the heat engine 100 can include coil windings 138 positioned along the entire or substantially along the entire length of the pipe sections 110-114 to provide the electromagnetic force, power take-off and/or extraction to electricity for the pistons 104-108 along the entire route within the pipe sections 110-114.

The pistons 104-108 can be fabricated from a magnetic material. Based on the magnetic material of the pistons 104-108 and the electromagnetic force and/or induction generated by the windings 138, the pistons 104-108 remain magnetically aligned and magnetically coupled (and/or linked) relative to each other as the pistons 104-108 move along their respective pathways between the pipe sections 110-114. For example, as shown in FIGS. 3-7, the piston 104 travels along pathway 140, the piston 106 travels along pathway 142, and the piston 108 travels along pathway 144. However, the pathways 140-144 form a continuous path that travels through each of the pipe sections 110-114. Therefore, the piston 104 initially travels along pathway 140, which transitions to pathway 142, which further transitions to pathway 144, and reconnects with pathway 140. Each piston 104-108 therefore travels along each of the pathways 140-144 during the continuous cycle operation of the heat engine 100. Due to the magnetic coupling of the pistons 104-108 relative to each other, as the pistons 104-108 travel along each of the pathways 140-144, the pistons 104-108 remain substantially aligned relative to each other. For example, the leading edge of the pistons 104-108 can remain substantially aligned relative to each other.

Ferrofluid can be used inside of the heat engine 100 to provide a dynamic seal around the pistons 104-108 as the traverse at least some of the pathways 140-144. The ferrofluid can include a magnetic iron fluid having iron nanoparticles suspended in a fluid. When placed around a magnetic material, the ferrofluid can substantially surround the magnet and acts as a bearing surface around the magnet. The ferrofluid can thereby act as a bearing surface around at least a portion of the magnetic pistons 104-108. The fluid nature of the ferrofluid creates a dynamic seal that can adjust as the diameters of pipe sections 110-114 change in the heat engine 100. The pistons 104-108 can each be dimensioned substantially equally, and further define a cylindrical configuration with a diameter configured to create a seal with the ferrofluid in the second pipe section 112 and the intermediary pipe section 114. The internal opening diameter of the first pipe section 110 can be dimensioned large enough to avoid a complete seal with the pistons 104-108 (even with the dynamic nature of the ferrofluid), to allow for movement of the working gas around the pistons 104-108. In some embodiments, rather than ferrofluid, an expandable rubber magnetic or electromagnetic piston (e.g., the piston of FIG. 21) can be used to achieve the dynamic sealing. In some embodiments, another suitably dynamic material for the piston 104-108 could be implemented.

In operation, working fluid or gas is introduced into the heat engine 100. The heat engine 100 can include one or more working charge ports to add the working gas charge or pre-charge to the pipe sections 110-114. The working fluid or gas can be, e.g., helium, air, any gas, or a phase change of water, organic fluids, HCFCs, or the like. Electric current can be applied to the coil windings 138 to generate the electromagnetic forces to initiate movement of the pistons 104-108 within their respective pipe sections 110-114. Hot and/or cold thermal transfer fluid flows in the respective pipe sections 110-114 can also assist in movement of the pistons 104-108. The pistons 104-108 each move in the same clockwise or counterclockwise direction, depending on the layout of the heat engine 100. In the first pipe section 110, the working gas is heated and the piston 104-108 does not seal the internal opening walls. Instead, the working gas is advanced sufficiently by the piston 104-108 inside of the first pipe section 110 towards the intermediary pipe section 114. In the intermediary pipe section 114, the ferrofluid creates a dynamic seal around the piston 104-108 relative to the inner opening walls and expansion of the working gas is achieved.

Expansion of the working gas helps create an internal force within the heat engine 100 to drive movement of the pistons 104-108. The pistons 104-108 are thereby driven by the expansion force (and maintain their magnetic linking) as a heat engine 100. In particular, the single piston of the pistons 104-108 traversing the intermediary pipe section 114 is propelled by the expansion force occurring within the heat engine 100, and the piston in the intermediary pipe section 114 further propels the piston in the second pipe section 112 to impart the compression force while the working fluid is cooled. The piston located in the pipe section 110 follows the path freely as the working gas is heated from the hot pipe walls. Each piston 104-108 therefore cyclically performs the respective roles in each of the pipe sections 110-114 as the pistons 104-108 traverse the internal pathways of each of the pipe sections 110-114.

As a heat pump configuration, electricity is consumed and imparted through the coil windings 138, causing a moving magnetic field motivation of the magnetic pistons 104-108, and forming a temperature gradient in the jacket space heat exchange spaces (as the heat pump is reverse from a heat engine operation). The forces acting on the pistons 104-108 are also reverse in the heat pump configuration as compared to the heat engine configuration. The intermediate diameter of the intermediary pipe section 114 accommodates incremental expansion of the working gas between the first and second pipe sections 110, 112 to ensure efficiency of the heat engine 100 operation. As the piston 104-108 progresses into the second pipe section 112, the ferrofluid creates a dynamic seal around the piston 104-108 relative to the inner opening walls, the working gas is cooled and compression occurs. In particular, the working gas is cooled from the pipe walls via the jacket space flowing thermal transfer fluid, allowing for compression to occur in a heat engine configuration, or heat to be rejected as compression occurs in the flowing thermal transfer fluid in the heat pump configuration.

Based on the magnetic coupling of the pistons 104-108, each of the respective pistons 104-108 is either passing through the first pipe section 110 to progress the heated working gas, passing through the intermediary pipe section 114 to create expansion of the working gas, or passing through the second pipe section 112 to cause or create the condition of incremental compression of the working gas. In particular, the working fluid or gas is heated from the pipe walls via the jacket space flowing thermal transfer fluid, allowing for expansion to occur in the heat engine configuration, or heat addition of the working fluid as expansion occurs, removing heat from the thermal transfer fluid in the heat pump configuration. Said in a different way, the working fluid or gas is heated and cooled, allowing for improved expansion and compression to occur in the heat engine configuration. Alternatively, heat addition and rejection to the working fluid can occur as expansion and compression occurs, moving heat from the thermal transfer fluid in the heat pump configuration. The heat engine 100 is therefore continuously operating the compression and expansion cycles.

FIGS. 8-13 are diagrammatic top, perspective, cross-sectional and detailed views of an exemplary heat engine 200 (e.g., a helical magnetic heat engine system). The heat engine 200 can be substantially similar to the heat engine 100, except for the distinctions discussed herein. Rather than three pipe sections that define substantially linear pathways along the same plane, the heat engine 200 includes two pipe sections that define substantially linear pathways along the same plane, and an intermediary pipe section that creates a helical pathway around the substantially linear pathways of the other pipe sections. The helical pathway increases the distance traveled by the piston within the intermediary pipe section (and the speed at which the piston travels), while maintaining each of the pistons substantially aligned based on the magnetic coupling of the pistons relative to each other.

In particular, the heat engine 200 includes a single pipe 202 continuously (or substantially continuously) formed to define an internal path along which pistons 204, 206, 208 travel to continuously perform the expansion and compression cycles. The pipe 202 is separated into the first pipe section 210 (e.g., a hot pipe, a hot major exterior pipe, or the like), a second pipe section 212 (e.g., a cold pipe, a cold minor exterior pipe, or the like), and an intermediary pipe section 214 (e.g., an intermediate pipe, an expansion exterior pipe, or the like).

The pipe sections 210, 212 are formed in loops and are connected to each other or the intermediary pipe section 214 to define the continuous internal path. The pipe sections 210, 212 extend along a substantially linear pathway along the same plane (e.g., along a horizontal plane), except for portions of the pipe sections 210, 212 that overlap or bend to facilitate connection between the pipe sections 210-214. The intermediary pipe section 214 defines a substantially helical pathway encircling the pipe sections 210, 212 except during the transition between the pipe section 210 to the intermediary pipe section 214, and the transition between the intermediary pipe section 214 to the pipe section 212. The pathway formed by the helical configuration is therefore longer than the linear pathway of the pipe sections 210, 212.

The heat engine 200 includes tapered transitions 216, 218 between the first pipe section 210 and the intermediary pipe section 214, and between the first and second pipe sections 210, 212. In some embodiments, a transition can be provided between the intermediary pipe section 214 and the second pipe section 212. The tapered transitions 216, 218 accommodate the difference in diameters of the pipe sections 210-214. The first pipe section 210 defines a first outer diameter and an internal opening 222 having a first inner diameter. In some embodiments, the first pipe section 210 can include an internal jacket space 224 between the internal opening 222 and the outer surface of the first pipe section 210 to provide an insulating effect for reduction in temperature losses of the working fluid. In some embodiments, a heat transfer fluid can be pumped through the jacket spaces 224, 228 to impart a hot and/or cold temperature gradient throughout the heat engine 200. Such gradient could occur in the corresponding pipe sections 210-224 for thermal exchange to the enclosed working gas and/or working fluid. The reverse can occur in a heat pump configuration. The second pipe section 212 defines a second outer diameter and an internal opening 226 having a second inner diameter. In some embodiments, the second pipe section 212 can include an internal jacket space 228 between the internal opening 226 and the outer surface of the second pipe section 212. The intermediary pipe section 214 defines a third outer diameter and an internal opening 230 having a third inner diameter. In some embodiments, the intermediary pipe section 214 can include a solid wall 232 between the internal opening 230 and the outer surface of the intermediary pipe section 214. In some embodiments, the solid wall 232 can be replaced with a jacket space similar to the jacket spaces 224, 228 of the first and second pipe sections 210, 212.

The relationship of the diameters of the pipe sections 210-214 can be similar to the diameters of the pipe sections 110-114 of the heat engine 100. In particular, The first inner diameter of the first pipe section 210 (and the outer diameter of the first pipe section 210) is dimensioned greater than the second inner diameter of the second pipe section 212 (and the outer diameter of the second pipe section 212) and the third inner diameter of the intermediary pipe section 214 (and the outer diameter of the intermediary pipe section 214). The third inner diameter of the intermediary pipe section 214 (and the outer diameter of the intermediary pipe section 214) is dimensioned greater than the second inner diameter of the second pipe section 212 (and the outer diameter of the second pipe section 212). The first pipe section 210 thereby defines the greatest internal pathway diameter, the intermediary pipe section 214 defines the next greatest internal pathway diameter, and the second pipe section 212 defines the smallest internal pathway diameter.

The heat engine 200 includes a hot heat exchanger 234 fluidly connected at opposing ends to the first pipe section 210 at or near the transition 216 and at or near the transition 218. The heat engine 200 includes a cold heat exchanger 236 fluidly connected at opposing ends to the second pipe section 212 at or near the transition 218 and downstream from the transition of the intermediary pipe section 214 to the second pipe section 212. The heat engine 200 includes one or more coil windings 238 for activating and driving the pistons 204-208. In some embodiments, the coil windings 238 can be used for electric power extraction via a moving magnetic flux induction. The heat engine 200 can include windings 238 positioned along the entire or substantially entire loop of the pipe sections 210-214. The pistons 204-208 remain magnetically coupled as they travel along respective pathways 240, 242, 244, ensuring the pistons 204-208 are substantially aligned relative to each other in their respective pipe sections 210-214. For example, the leading edge, trailing edge, or central point of the pistons 204-208 can be substantially aligned relative to each other along the same plane (e.g., vertical, lateral plane). The piston 204-208 traveling along the helical pathway 244 therefore travels a greater distance at a greater speed than the pistons 204-208 traveling along the substantially linear pathways 240, 242. However, during the continuous operation of the heat engine 200, each piston 204-208 travels along the pathways 240-244 in sequential order. Ferrofluid (or the piston of FIG. 21) can be used to create the dynamic seal between the pistons 204-208 and the inner walls of the pathways 240-244.

In operation, working fluid or gas is introduced into the heat engine 200. Current can be applied to the coil windings 238 to generate the electromagnetic forces to initiate movement of the pistons 204-208 within the respective pipe sections 210-214. The pistons 204-208 each move in the same clockwise or counterclockwise direction, with one of the pistons 204-208 traversing in the clockwise or counterclockwise direction along the helical path. In the first pipe section 210, the working gas is heated and the piston 204-208 inside of the first pipe section 210 does not seal the internal opening walls. Instead, the working gas is advanced sufficiently by the piston 204-208 inside of the first pipe section 210 towards the intermediary pipe section 214. In the intermediary pipe section 214, the ferrofluid creates a dynamic seal around the piston 204-208 relative to the inner opening walls and expansion of the working gas is achieved. Expansion of the working gas helps create or cause an internal force within the heat engine 200 to drive movement of the pistons 204-208. The intermediate diameter of the intermediary pipe section 214 accommodates gradual expansion of the working gas between the first and second pipe sections 210, 212 to ensure efficiency of the heat engine 200 operation. The helical pathway of the intermediary pipe section 214 increases the length of the pathway and speed at which the piston of the pistons 204-208 traversing the intermediary pipe section 214 travels, resulting in an increase in expansion achievable by the heat engine 200.

As the piston 204-208 progresses into the second pipe section 212, the ferrofluid creates a dynamic seal around the piston 204-208 relative to the inner opening walls, the working gas is cooled and incremental compression occurs. In particular, the working fluid or gas is heated from the pipe walls via the jacket space flowing thermal transfer fluid, allowing for expansion to occur in the heat engine configuration, or heat addition of the working fluid as expansion occurs, removing heat from the thermal transfer fluid in the heat pump configuration. Said in a different way, the working fluid or gas is heated and cooled, allowing for improved expansion and compression to occur in the heat engine configuration. Alternatively, heat addition and rejection to the working fluid can occur as expansion and compression occurs, moving heat from the thermal transfer fluid in the heat pump configuration. Based on the magnetic coupling and/or linking of the pistons 204-208, each of the respective pistons 204-208 is either passing through the first pipe section 210 to progress the heated working gas, passing through the intermediary pipe section 214 to create expansion of the working gas, or passing through the second pipe section 212 to create incremental compression of the working gas. The heat engine 200 is therefore continuously operating the compression and expansion cycles.

FIGS. 14-19 are diagrammatic top, perspective, cross-sectional and detailed views of an exemplary heat engine 300 (e.g., an internal combustion helical heat engine system). The heat engine 300 can be substantially similar to the heat engines 100, 200, except for the distinctions discussed herein. Rather than including three pipe sections, the heat engine 300 includes two pipe sections—a first pipe section that defines a substantially linear pathway, and a second pipe section that defines a substantially helical pathway around the first pipe section. Instead of a hermetically (or quasi-hermetically charged) enclosed system for the working gas (as is done in the heat engines 100, 200), the heat engine 300 includes features for introduction of outside air into the heat engine 300 and exhausting combustion gases.

In particular, the heat engine 300 includes a single pipe 302 continuously (or substantially continuously) formed to define an internal path along which pistons 304, 306 travel to continuously perform the expansion and compression cycles. The pipe 302 is separated into the first pipe section 310 and a second pipe section 312. The pipe sections 310, 312 are formed in loops and are connected to each other at respective opposing ends to define the continuous internal path. The pipe section 310 extends along a substantially linear pathway along the same plane (e.g., along a horizontal plane). The pipe section 312 defines a substantially helical pathway encircling the pipe section 310 except during the transition between the pipe section 312 and the pipe section 310. The pathway formed by the helical configuration is therefore longer than the linear pathway of the pipe section 310.

The outer and inner diameters of the pipe sections 310, 312 can be dimensioned substantially equally and, therefore, the heat engine 300 does not include tapered transitions. In particular, the pipe section 310 defines an outer diameter and an internal opening 322 having a first inner diameter, and the pipe section 312 defines an outer diameter and an internal opening 326 having a second inner diameter substantially equal to the first inner diameter. The pipe sections 310, 312 can include an internal jacket space (or a solid wall) between the respective internal openings 322, 326 to provide an insulating effect for reduction in temperature losses of the working fluid. In some embodiments, insulation of one or more partial or full sections of the pipe sections 310, 312 could be used. In some embodiments, if a jacket space is used, a thermal transfer fluid exchange could be used for a reheat, cooling, regeneration, or intercooling effect or process.

At the connection between the pipe sections 310, 312, the heat engine 300 includes an air intake induction/exhaust section 346 including a plurality of openings into the internal passage of the pipe sections 310, 312. The section 346 allows for intake or exhaust of outside air into the internal passage of the pipe sections 310, 312 to mix outside air with the working gas during the compression and expansion cycles. The heat engine 300 includes a high pressure fuel spray injector 348 and an adjacently positioned spark plug ignition/igniter 350. The injector 348 and igniter 350 can be disposed downstream from the connection between the first and second pipe sections 310, 312. In some embodiments, the section 346 can be at a first connection between the pipe sections 310, 312, and the injector 348 and igniter 350 can be at the other connection between the pipe sections 310, 312.

In some embodiments, no hot or cold heat exchangers are included in the heat engine 300. In some embodiments, the heat engine 300 can include a heat exchangers. The heat engine 300 includes coil windings 338 for generating the electromagnetic force to activate and drive the pistons 304, 306. The heat engine 300 can include windings 338 positioned along the entire or substantially entire loop of the pipe sections 310, 312. The pistons 304, 306 remain magnetically coupled as they travel along respective pathways 340, 342, with the magnetic coupling maintaining the pistons 304, 306 substantially aligned relative to each other along the same plane (e.g., vertical, lateral plane). The piston 304, 306 traveling along the helical pathway 342 therefore travels a greater distance at a greater speed than the piston 304, 306 traveling along the substantially linear pathway 340. However, during the continuous operation of the heat engine 300, each piston 304, 306 travels along the pathways 340, 342 in sequential order.

In operation, working fluid or gas is introduced into the heat engine 300. Current can be applied to the coil windings 338 to generate the electromagnetic forces to initiate movement of the pistons 304, 306 within the respective pipe sections 310, 312. In some embodiments, the coil windings 338 can provide electric power extraction via a moving magnetic flux induction. The pistons 304, 306 each move in the same clockwise or counterclockwise direction, with one of the pistons 304, 306 traversing in the clockwise or counterclockwise direction along the helical path. In the first pipe section 310, the working gas or fluid is compressed and may be cooled, while in the second pipe section 312, the working gas is heated and expanded. Outside air is introduced by the ports or openings in the section 346 during the continuous operating cycle. Air is compressed by the magnetically linked pistons 304, 306 imparting a mechanical advantage (e.g., machine inclined plane principle) from the helical hot combustion gas section. As the cycle's magnetically linked pistons 304, 306 continue in the repetitive loop, the hot combustion gases are expelled or exhausted from the ports of the section 346. In some embodiments, a naturally liquid or gas fuel and spark can be provided by the injector 348 and igniter 350, depending on the desired compression ratio. In some instances, a permanent physical magnet can lose all magnetism at high temperatures, which is known as the Curie temperature. Such loss of magnetism can be addressed by the exemplary piston shown in FIG. 21.

Figure 20:
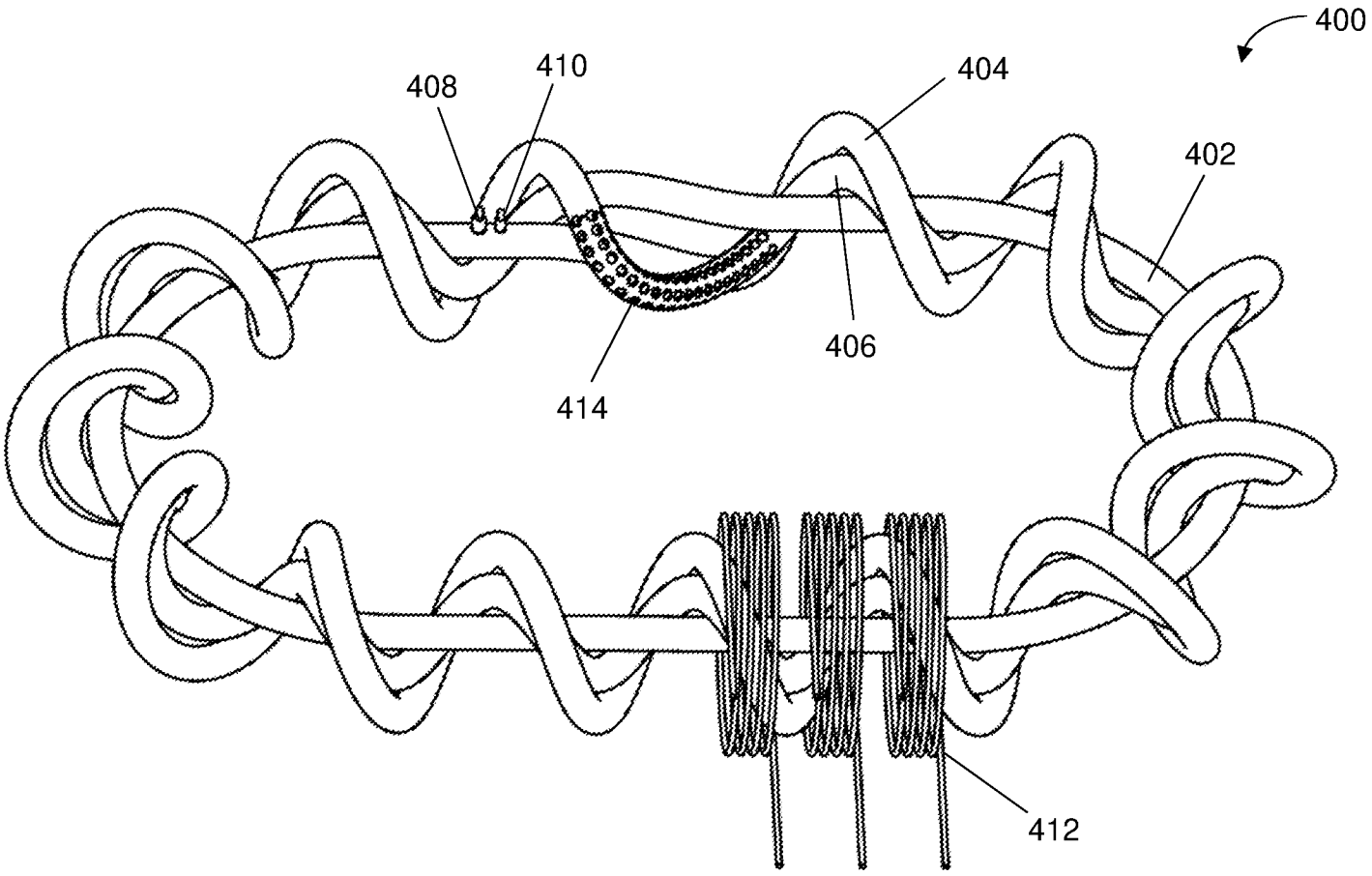
FIG. 20 is a perspective diagrammatic view of an exemplary heat engine in accordance with the present disclosure.

FIG. 20 is a diagrammatic perspective view of an exemplary heat engine 400. The heat engine 400 can be substantially similar to the heat engines 200, 300, except for the distinctions noted herein. Rather than including a helical intermediary pipe section and substantially linear first and second pipe sections (e.g., heat engine 200), or a single substantially linear first pipe section surrounded by a helical intermediary pipe section (e.g., heat engine 300), the heat engine 400 includes a single substantially linear intermediary pipe section 402 surrounded by helical first and second pipe sections 404, 406. The second pipe section 406 functions as a compression chamber. The intermediary pipe section 402 functions as a working fluid accumulation or pressurization chamber. The first pipe section 404 functions as an expansion chamber that drives the magnetic piston passing through the first pipe section 404 and, each of the three internal, magnetically linked pistons (not shown) by mechanical advantage. Each of the three pistons continuously circulates the internal pathway of the heat engine 400, sequentially passing through the pipe sections 402-406 while maintaining the substantially aligned and magnetically linked connection. Liquid or gas fuel is added at the fuel injector 408, and an igniter 410 is provided. As combustion occurs, excess kinetic energy can be drawn off by the generator winding coils 412. The heat engine 400 also includes the air intake induction/exhaust section 414.

Figure 21:
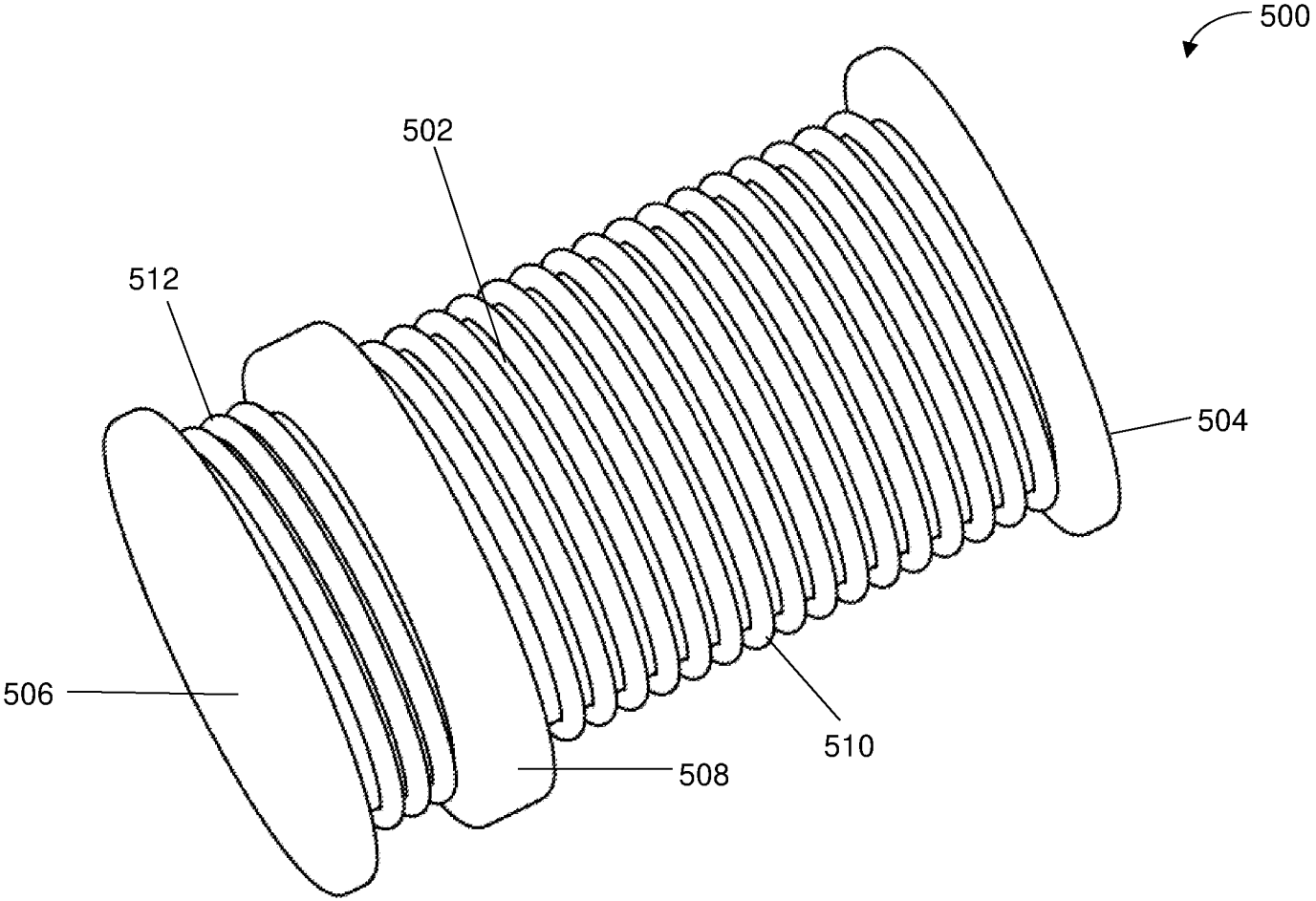
FIG. 21 is a perspective view of an exemplary piston in accordance with the present disclosure.

FIG. 21 is a perspective view of an exemplary piston 500 (e.g., an electromagnetic piston) capable of being used with the heat engines discussed herein. The piston 500 generally includes a body 502 with two ends 504, 506 defined by radial flanges. The ends 504, 506 can define diameters dimensioned greater than the cross-sectional diameter of the cylindrical body 502 to ensure the position of windings is maintained on the body 502. The piston 500 includes a central, separating flange 508 extending from the body 502. The flange 508 can be positioned closer to the end 506. The piston 500 includes a large winding 510 (e.g., coil winding) and a small winding 512 (e.g., coil winding) fabricated from a conductive material (e.g., copper, materials suitable for high temperatures, or the like). The small winding 512 can receive an external DC or AC magnetic field, which can induce an electromagnetic field (EMF) into the large winding 510. The coil windings on the exterior of the heat engine can induce electrical current to the small winding 512, which results in a generator or alternator, motor effect on the piston 500 via exclusively electromotive force excitation. Therefore, no physical permanent magnet is used with the piston 500, preventing alteration of operation of the heat engine due to the Curie temperature effect. It should be understood that the piston 500 can be used as the pistons discussed with respect to the heat engines 100, 200, 300.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A heat engine, comprising:

a pipe that defines a continuous internal path, the pipe including a first pipe section and a second pipe section;

a first piston disposed within the first pipe section; and a second piston disposed within the second pipe section;

wherein the first and second pistons are magnetically linked to travel along the continuous internal path of the pipe; and wherein (i) a diameter of the pipe varies along the continuous internal path, or (ii) the second pipe section defines a helical pathway around the first pipe section.

2. The heat engine of claim 1, wherein the first pipe section includes a first end and an opposing second end, and the second pipe section includes a first end and an opposing second end.

3. The heat engine of claim 2, wherein the first end of the first pipe section is connected to the second end of the second pipe section, and the first end of the second pipe section is connected to the second end of the first pipe section.

4. The heat engine of claim 2, comprising a third pipe section including a first end and an opposing second end, wherein the first end of the first pipe section is connected to the second end of the third pipe section, and the first end of the second pipe section is connected to the second end of the third pipe section, the first, second and third pipe sections defining the continuous internal path.

5. The heat engine of claim 1, comprising an external driving mechanism configured to generate electromagnetic forces to drive the magnetically linked travel of the first and second pistons along the continuous internal path of the pipe.

6. The heat engine of claim 5, wherein the external driving mechanism includes coil windings disposed around the first and second sections of the pipe.

7. The heat engine of claim 1, wherein the first pipe section defines a first loop of the pipe and the second pipe section defines a second loop of the pipe, the first and second loops traversing along a shared plane.

8. The heat engine of claim 1, wherein the first pipe section defines a loop of the pipe and the second pipe section defines the helical pathway around the loop formed by the first pipe section.

9. The heat engine of claim 8, wherein the helical pathway defines a longer pathway than a pathway of the loop.

10. The heat engine of claim 9, wherein during the magnetically linked travel of the first and second pistons along the continuous internal path of the pipe, a speed of the first or second piston traveling through the helical pathway is greater than a speed of the first or second piston traveling through the loop.

11. The heat engine of claim 1, wherein in one complete cycle, the first piston travels along the continuous internal path through the first pipe section, into the second pipe section, through the second pipe section, and back to the first pipe section.

12. The heat engine of claim 11, wherein in the one complete cycle, the second piston travels along the continuous internal path through the second pipe section, into the first pipe section, through the first pipe section, and back to the second pipe section.

13. The heat engine of claim 12, wherein the first and second pistons remain magnetically linked during travel through the respective first and second pipe sections.

14. The heat engine of claim 1, wherein the pipe is fabricated from a non-magnetic material, and the first and second pistons are fabricated from a magnetic material.

15. The heat engine of claim 1, comprising ferrofluid disposed within the continuous internal path of the pipe, the ferrofluid providing a dynamic seal between an inner surface of the pipe and the respective first and second pistons.

16. The heat engine of claim 1, wherein the magnetically linked travel of the first and second pistons along the continuous internal path of the pipe achieves continuous compression and expansion cycles.

17. The heat engine of claim 1, wherein the first pipe section defines a diameter greater than a diameter of the second pipe section.

18. The heat engine of claim 2, comprising a hot heat exchanger fluidly connected to the first pipe section at or near the first and opposing second ends, and a cold heat exchanger fluidly connected to the second pipe section at or near the first and opposing second ends.

19. A method of operating a heat engine, the method comprising:

driving travel of a first piston and a second piston of a heat engine along a continuous internal path of a pipe, the heat engine including (i) the pipe that defines the continuous internal path, the pipe including a first pipe section and a second pipe section, (ii) the first piston disposed within the first pipe section, and (iii) the second piston disposed within the second pipe section; and maintaining the first and second piston magnetically linked to each other during travel along the continuous internal path of the pipe;

wherein (i) a diameter of the pipe varies along the continuous internal path, or (ii) the second pipe section defines a helical pathway around the first pipe section.

20. The method of claim 19, wherein:

in one complete cycle, the first piston travels along the continuous internal path through the first pipe section, into the second pipe section, through the second pipe section, and back to the first pipe section;

in the one complete cycle, the second piston travels along the continuous internal path through the second pipe section, into the first pipe section, through the first pipe section, and back to the second pipe section; and the first and second pistons remain magnetically linked during travel through the respective first and second pipe sections.

* * * * *